US011375793B2

(12) United States Patent
Penaflor

(10) Patent No.: US 11,375,793 B2
(45) Date of Patent: Jul. 5, 2022

(54) FACIAL HAIR SHAPING TOOL AND COMB

(71) Applicant: Ronaldo Green Penaflor, Fallbrook, CA (US)

(72) Inventor: Ronaldo Green Penaflor, Fallbrook, CA (US)

(73) Assignee: iP TECH PROS Inc., San Diego, CA (US)

( * ) Notice: Subject to any disclaimer, the term of this patent is extended or adjusted under 35 U.S.C. 154(b) by 287 days.

(21) Appl. No.: 16/572,632

(22) Filed: Sep. 17, 2019

(65) Prior Publication Data

US 2020/0229573 A1 Jul. 23, 2020

Related U.S. Application Data

(63) Continuation-in-part of application No. 16/278,715, filed on Feb. 19, 2019, now Pat. No. 11,019,897, which is a continuation-in-part of application No. 16/257,044, filed on Jan. 24, 2019, now abandoned, which is a continuation-in-part of application No. 16/252,659, filed on Jan. 20, 2019, now Pat. No. 11,178,951.

(51) Int. Cl.

| | |
|---|---|
| ***A45D 24/06*** | (2006.01) |
| ***A45D 27/00*** | (2006.01) |
| ***A45D 24/36*** | (2006.01) |

(52) U.S. Cl.

CPC ..... *A45D 24/06* (2013.01); *A45D 24/36* (2013.01); *A45D 27/00* (2013.01)

(58) Field of Classification Search

CPC ..... A45D 24/06; A45D 27/00; A45D 24/36
USPC ..... 132/213, 213.1, 129, 131, 132, 133, 134
See application file for complete search history.

(56) References Cited

U.S. PATENT DOCUMENTS

| | | | | | |
|---|---|---|---|---|---|
| 55,349 | A | * | 6/1866 | Noyes | A45D 2/44 132/132 |
| 641,531 | A | * | 1/1900 | Murphy | A45D 24/08 132/119 |
| 673,098 | A | * | 4/1901 | Tissier | A45D 8/34 132/133 |
| 1,579,143 | A | * | 3/1926 | Rabb | A45D 24/06 132/134 |
| 1,607,564 | A | * | 11/1926 | Rabb | A45D 24/06 132/134 |
| 1,615,408 | A | | 1/1927 | Scott | |
| 1,616,930 | A | * | 2/1927 | Strauss | A45D 24/06 132/134 |
| 1,636,870 | A | * | 7/1927 | Scholl | A45D 24/06 132/134 |
| 1,651,746 | A | * | 12/1927 | Backes | A45D 24/06 132/134 |

(Continued)

*Primary Examiner* — Nicholas D Lucchesi

(57) ABSTRACT

The invention provides a facial hair shaping tool and comb for personal grooming, including a first guide member and a second guide member that are identical or nearly identical in size and shaped like a comb with a handle, coupled at a centerline separating the first guide member and the second guide member at two end portions. Each guide member is relatively thin compared to its overall size, having an elongated planar body with at least one curvilinear segment, and includes additional members that allows the facial hair shaping tool and comb to convert between a conjoined facial hair shaping tool (opened state) to a miniature comb (closed state), and vice versa.

18 Claims, 19 Drawing Sheets

(56) References Cited

U.S. PATENT DOCUMENTS

| | | | | | |
|---|---|---|---|---|---|
| 2,154,120 | A * | 4/1939 | Berliner | A45D 24/06 | 132/122 |
| 2,479,142 | A * | 8/1949 | Taylor | A45D 24/06 | 132/132 |
| 2,591,835 | A * | 4/1952 | Lakeland | A45D 24/36 | 132/126 |
| 2,698,018 | A * | 12/1954 | Post | A45D 24/36 | 132/213 |
| 3,125,101 | A * | 3/1964 | Clark | A45D 24/36 | 132/213.1 |
| 3,407,823 | A | 10/1968 | Selvaggio | | |
| 3,648,321 | A * | 3/1972 | Vallis | A45D 24/06 | 15/185 |
| 4,009,725 | A * | 3/1977 | Stuart | A45D 24/10 | 132/104 |
| 4,414,991 | A * | 11/1983 | Marcotte | A45D 24/36 | 132/214 |
| 4,483,354 | A * | 11/1984 | Marcotte | A45D 24/36 | 132/213 |
| 4,502,232 | A | 3/1985 | Broders | | |
| 4,926,891 | A * | 5/1990 | Fani | A45D 24/36 | 132/213 |
| 5,329,946 | A | 7/1994 | Guma | | |
| 5,427,122 | A * | 6/1995 | Hamilton | A45D 24/36 | 132/214 |
| 5,875,790 | A * | 3/1999 | Morrison | A45D 24/36 | 132/213.1 |
| 6,267,119 | B1 * | 7/2001 | Silva | A45D 8/30 | 132/213 |
| 7,073,517 | B1 * | 7/2006 | Burnette, III | A45D 24/06 | 132/144 |
| 7,252,094 | B2 | 8/2007 | Maynard | | |
| D589,648 | S | 3/2009 | Bakus | | |
| 7,559,331 | B2 | 7/2009 | Ward | | |
| 8,800,572 | B1 * | 8/2014 | Hodge | A45D 24/36 | 132/213.1 |
| 9,661,909 | B2 | 5/2017 | Brunett | | |
| 10,220,531 | B2 * | 3/2019 | Millis | B26B 19/20 | |
| 2007/0261709 | A1 | 11/2007 | Bakus | | |
| 2009/0101160 | A1 | 4/2009 | Ruckart | | |
| 2009/0223530 | A1 | 9/2009 | Chapman | | |
| 2010/0252059 | A1 * | 10/2010 | Peverini | A45D 24/16 | 132/120 |
| 2012/0234341 | A1 | 9/2012 | Kingery | | |
| 2013/0213429 | A1 | 8/2013 | Allen | | |
| 2016/0235180 | A1 * | 8/2016 | Brunett | A45D 24/02 | |

* cited by examiner

FACIAL HAIR SHAPING TOOL AND COMB

RELATED APPLICATIONS

This application claims the benefit of priority of U.S. application Ser. No. 16/252,659, filed Jan. 20, 2019, U.S. application Ser. No. 16/257,044, filed Jan. 24, 2019, and U.S. application Ser. No. 16/278,715, filed Feb. 10, 2019, which are herein incorporated by reference to the present application.

FIELD OF THE INVENTION

The present invention relates to a facial hair shaping tool and comb. Particularly, the facial hair shaping tool and comb includes at least a first guide member and second guide member that are identical or nearly identical in size and shaped like a comb with a handle, coupled at a centerline disposed between the first guide member and the second guide member at two end portions. Each guide member is relatively thin compared to its overall size, having an elongated planar body with at least one curvilinear segment, and includes additional members that allows the facial hair shaping tool and comb to convert between a full-length facial hair shaping tool, when opened, to a miniature comb, when closed, and vice versa.

BACKGROUND

Shaving or trimming facial hair such as beards, mustaches, sideburns, and eyebrows can be accomplished by all sorts of cutting and shaving tools, including scissors, razors blades, electric shaves, and barber shaving knives. These cutting and shaving tools may be used in combination with commercial facial hair shaping tools to achieve a symmetrical, clean and even look. For example, various types of conventional beard shaping tools and comb are available but all large and oddly shaped, making it difficult to carry in pocket or store while on the go.

However, these types of conventional beard shaping tools can be difficult to use, store or carry for everyday facial hair grooming needs. Thus, there is a need for an improved facial hair shaping tool and comb that is different from all conventional shaping tools, having several new and improved advantages not offered by the conventional shaping tools.

SUMMARY

It is an advantage of the present invention to provide a facial hair shaping tool and comb for shaping and grooming facial hair of a user, including a first guide member having a first elongated planar body, a first handle, a first end portion, a first curvilinear segment disposed on a first side of the first elongated planar body between the first handle and the first end portion, and a first plurality of comb teeth disposed on a second side of the first elongated planar body between the first handle and the first end portion. A second guide member having a second elongated planar body, a second handle, a second end portion, and a second curvilinear segment disposed on a first side of the second elongated planar body between the second handle and the second end portion, and a second plurality of comb teeth disposed on a second side of the second elongated planar body between the second handle and the second end portion. The first guide member may be coupled to the second guide member by a fastener, allowing the first guide member or the second guide member to move and enabling the facial hair shaping tool and comb to be in an opened state or a closed state. The first guide member and the second guide member may be symmetrically arranged to one another relative to a centerline disposed between the first guide member and the second guide member. The first guide member and the second guide member may be converted into a conjoined facial hair shaping tool when the facial hair shaping tool and comb is in the opened state, and the first guide member and the second guide member may be converted into a miniature comb when the facial hair shaping tool and comb is in the closed state.

In one embodiment, the first curvilinear segment and the second curvilinear segment may be conjoined forming a single curvilinear segment. In another embodiment, the first handle lies horizontally flat and against the second handle, forming a single handle assembly in the closed compact state. In yet another embodiment, the first elongated body and the second elongated body may act as a barrier, masking and covering a protected portion of the facial hair.

In first aspect, the facial hair shaping tool and comb in the opened state may have a width of about 5 inches to 6 inches and a length of about 1¾ inches to 2½ inches. In second aspect, the facial hair shaping tool and comb in the opened state may have a thickness of about 1.5 mm to 3 mm. In third aspect, the miniature comb may have a width of about 2¾ inches to 3 inches, and a length of about 1 inches to 2 inches. In fourth aspect, the miniature comb may have a thickness of about 3 mm to 6 mm.

In one implementation, a retainer clip or a magnet may be coupled to the miniature comb. In yet another implementation, the first end portion may be coupled to the second end portion by the fastener. In another embodiment, the fastener may include a flexible adhesive fastener applied to at least one side of the facial hair shaping tool and comb, wherein the first guide member may be coupled to the second guide member via the flexible adhesive fastener, allowing the facial hair shaping tool and comb to fold and unfold along the centerline. In still yet another implementation, the flexible adhesive fastener may include a shaped flexible adhesive fastener, having a thin flexible adhesive material which may be patterned to match a shape of the first guide member and the second guide member.

In one manner, the fastener includes a mechanical or a magnetic fastener may be connected to the first end portion and the second end portion, the first guide member may be coupled to the second guide member via the mechanical or the magnetic fastener, allowing the facial hair shaping tool and comb to fold and unfold along the centerline. In another manner, the first plurality of comb teeth may be structurally aligned and in contact with the second plurality of comb teeth, forming a single comb assembly in the closed compact state. In still another manner, the single comb assembly is approximate 35 mm-45 mm in width and approximately 8 mm-12 mm in length, having finely spaced or coarsely spaced teeth. In still yet another manner, the first curvilinear segment or the second curvilinear segment may include a sloped edge.

In a first aspect, the sloped edge may have an acute angle. In a second aspect, the first handle may be coupled to the second handle by the fastener. In a third aspect, the fastener may include a rod-type fastener inserted into a plurality of holes disposed near a center portion of the first handle and the second handle, allowing the first guide member and second guide member to rotate around the rod-type fastener. In a fourth aspect, the rod-type fastener may include rollers, bolts, pins, rivets, cylinders, threaded or partially threaded screws, magnetic pins, magnetic pegs or magnetic discs.

Some advantages of the facial hair shaping tool and comb may include 1) compactness, space-savings, portability, smooth, and light-weight design, allowing a user to easily store it in their wallet or pocket; 2) replaceable and interchangeable parts, allowing the user to replace broken parts or upgrade to new parts; and 3) diverse components, offering a variety of unique parts for facial shaping and grooming.

These and other objects, features, and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, one or more elements may have the same reference numeral in different figures, indicating that it was previously described.

DETAILED DESCRIPTION

Embodiments in this disclosure include a novel facial hair shaping tool and comb for personal grooming.

Unlike the conventional hair shaping tools and folding combs which are typically large and oddly shaped to fully fit and carry inside an average size pants or shirt pockets, the facial hair shaping tool and comb presented herein provides users a unique compact hair grooming device that converts a full-length facial hair shaping tool (approximately 6 inches in total width) into a miniature comb (approximately 3 inches in total width), and vice versa.

Figure 1:
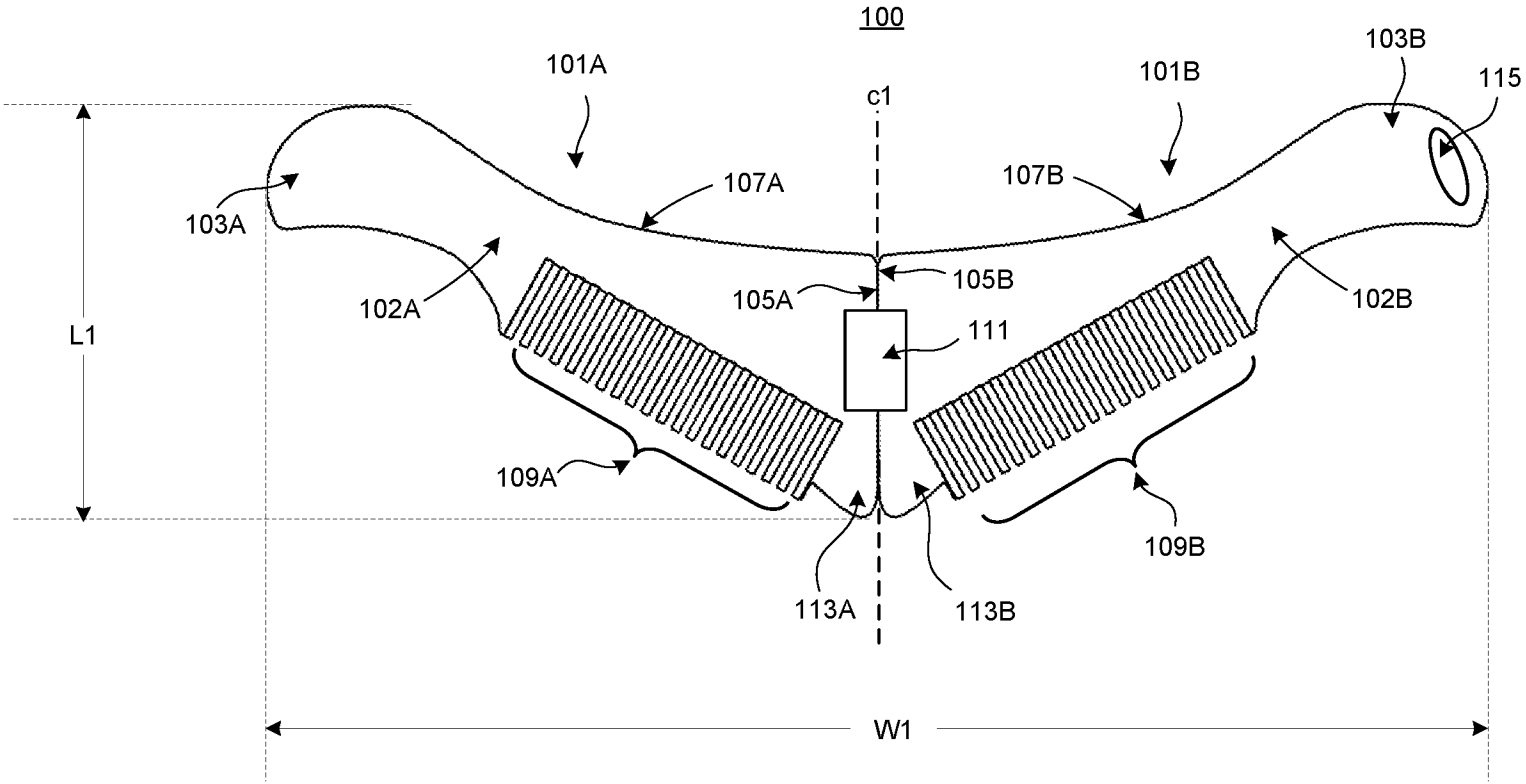
FIG. 1 illustrates a front view of a facial hair shaping tool and comb, according to an embodiment.

FIG. 1 illustrates a front view of a facial hair shaping tool and comb 100 according to an embodiment. As depicted in this embodiment, the facial hair shaping tool and comb 100 may include a first guide member 101A and a second guide member 101B that are identical or nearly identical in size and shaped like a comb with a handle, symmetrically arranged to one another relative to a centerline c1 disposed between the first guide member 101A and the second guide member 101B at two end portions 105A, 105B. Each guide member, 101A and 101B, is relatively thin compared to its overall size, having an elongated planar body with at least one curvilinear segment, and includes additional members that allows the facial hair shaping tool and comb 100 to convert between a full-length facial hair shaping tool (i.e., opened state, as depicted in FIG. 1) to a miniature comb (i.e., closed state as depicted later in FIG. 3A-FIG. 3D), and vice versa. For example, the first guide member 101A may include a first elongated planar body 102A, a first handle 103A, a first end portion 105A, a first curvilinear segment 107A disposed on a first side of the first elongated planar body 102A between the first handle 103A and the first end portion 105A, and a first plurality of comb teeth 109A disposed on a second side of the first elongated planar body 102A between the first handle 103A and the first end portion 105A. Similarly, the second guide member 101B may include a second elongated planar body 102B, a second handle 103B, a second end portion 105B, a second curvilinear segment 107B disposed on a first side of the second elongated planar body 102B between the second handle 103B and the second end portion 105B, and a second plurality of comb teeth 109B disposed on a second side of the second elongated planar body 102B and between the second handle 103B and the second end portion 105B. A flexible adhesive fastener 111 may be applied to the front and/or back side face of the facial hair shaping tool and comb 100 at the first and second end portions, 105A and 105B, coupling and joining the first guide member 101A to the second guide member 101B, allowing it to fold and unfold along the centerline c1. The flexible adhesive fastener 111 may include various adhesive films, adhesive plastics, vinyl tapes, adhesive fabrics, or other adhesive materials that are flexible, strong, and durable enough to withstand and endure the repetitive folding and unfolding of the facial hair shaping tool and comb 100 when in everyday use. Common materials that may be employed to fabricate the facial hair shaping tool and comb 100 include plastics, carbon fiber, composite materials, metals, wood, thermoplastics, and other synthetic or natural durable materials. In practice, the facial hair shaping tool and comb 100 may be held and supported at a guide handle, 113A and 113B, when in the opened state as shown in FIG. 1. Additional details, description, and method of operational use of the facial hair shaping tool and comb 100 by a user are provided later in this document. An optional tab 115, including a small protrusion or small indentation on the surface of the handle body, may be applied to one of the handles, 103A or 103B, when used with and inserted into the pocket utility case and travel tool as described in U.S. application Ser. No. 16/278,715, which is incorporated by reference to the present application. In the opened state, the facial hair shaping tool and comb 100 may have a width (W1) of about 5 inches to 6 inches and a length (L1) of about 1¾ inches to 2½ inches in order to accommodate the size of the average size face of about 8" in length.

Figure 2A:
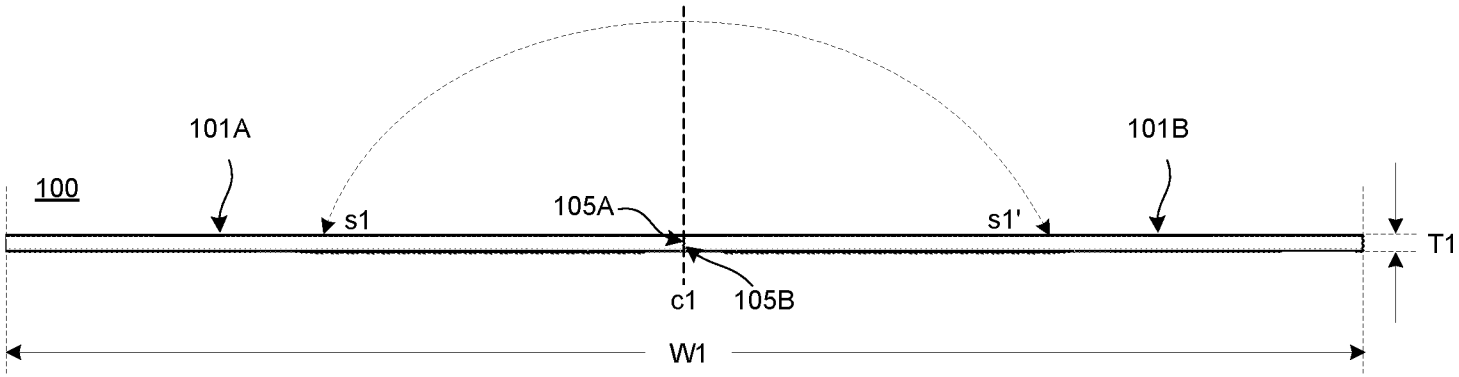
FIG. 2A-FIG. 2B illustrate a top view and a top perspective view of a method of converting the facial hair shaping tool and comb from the opened state to the closed state and vice versa, according to an embodiment.
Figure 2B:
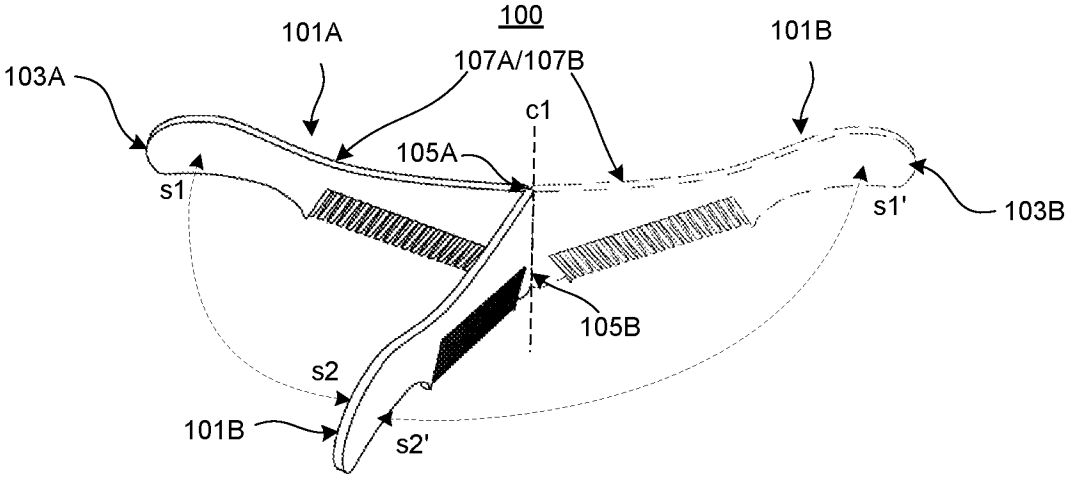
Figure 3A:
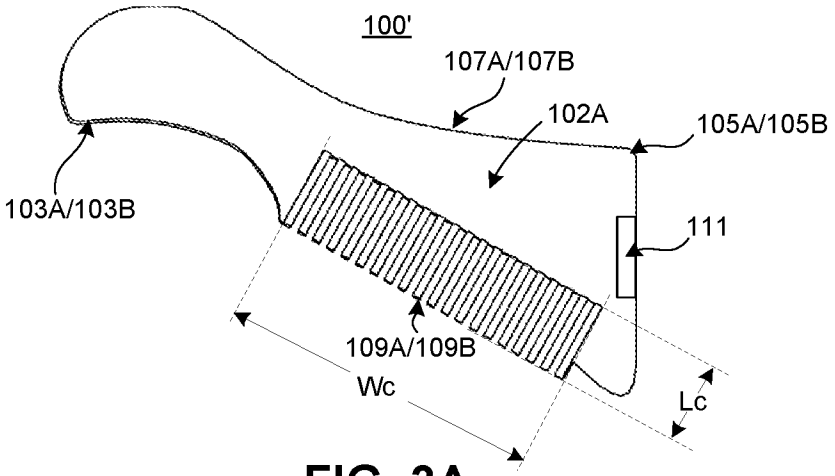
FIG. 3A-FIG. 3D illustrate a front view, top view, side view, and a top perspective view of the facial hair shaping tool and comb in its closed compact state, converting into a miniature comb, according to an embodiment.
Figure 3B:
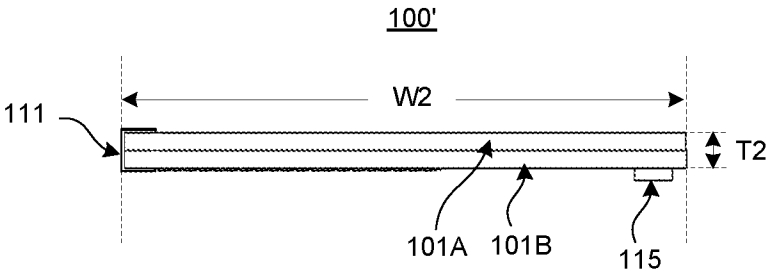
Figure 3C:
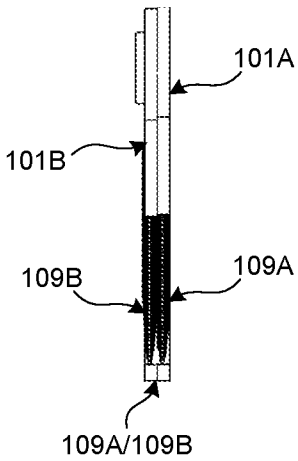
Figure 3D:
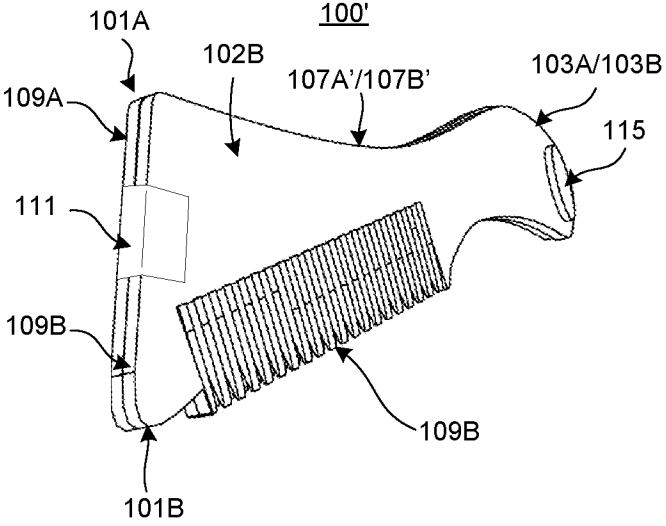

FIG. 2A-FIG. 2B illustrate a top view and a top perspective view of a method of converting the facial hair shaping tool and comb 100 from the opened state to the closed state and vice versa, according to an embodiment. The steps for closing or compacting the facial hair shaping tool and comb 100 from its opened state (as a full-length facial hair shaping tool) to its closed state (as a miniature comb) include grasping the second handle 103B at position s1' and then folding it about the centerline c1 towards s2/s2' until it makes contact with the first handle 103A at position s1. Conversely, the steps for opening or expanding the facial hair shaping tool and comb 100 from its closed state (as the miniature comb) to its opened state (as a full-length facial hair shaping tool) include grasping the second handle 103B at position s1 and then unfolding it about the centerline c1 towards s2/s2' until the front face of the facial hair shaping tool and comb 100 lays horizontally flat or 180 degrees, converting the facial hair shaping tool and comb 100 into a conjoined facial hair shaping tool. In particular, the first curvilinear segment 107A and the second curvilinear segment 107B are also conjoined, forming a single curvilinear segment 107A/107B on the conjoined facial hair shaping tool. In the opened state, the facial hair shaping tool and comb 100 has a relatively thin body, having a thickness (T1) of about 1.5 mm to 3 mm, providing a structure that is rigid and sturdy enough to be used as a shaving guide edge.

FIG. 3A-FIG. 3D illustrate a front view, top view, side view, and a top perspective view of the facial hair shaping tool and comb 100 in its closed compact state, converting into a miniature comb 100', according to an embodiment. In the closed compact state, the first handle 103A lies horizontally flat and against the second handle 103A, making it a single handle assembly (103A/103B). Also in the closed compact state, the first plurality of comb teeth 109A are structurally aligned and in contact with the second plurality of comb teeth 109B, converting it into a single comb teeth assembly 109A/109B. In the closed state, the length of the facial hair shaping tool and comb 100 is now reduced to half of its original size, having a width (W2) of about 2¾ inches to 3 inches. In contrast, the miniature comb 100' has a thickness of about 3 mm to 6 mm, effectively doubling the thickness of the facial hair shaping tool and comb 100 as compared against its original thickness. The dimensions of the plurality of teeth assembly 109A/109B of the miniature comb are approximate 35 mm-45 mm in width (Wc) and approximately 8 mm-12 mm in length (Lc), having finely spaced or coarsely spaced teeth.

Figure 4:
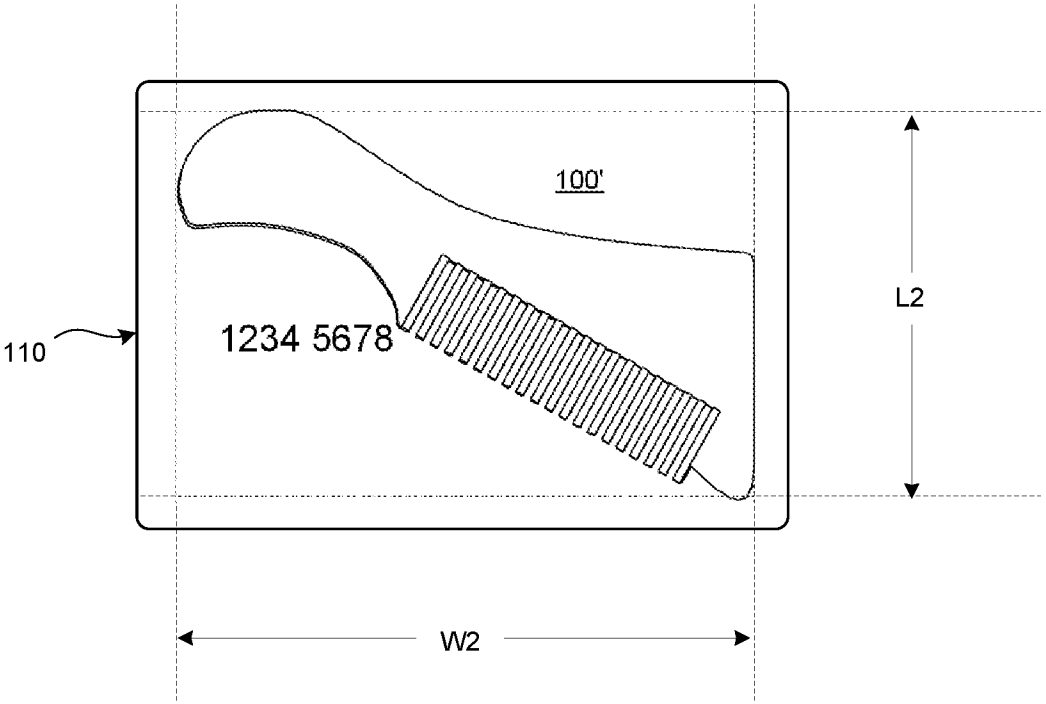
FIG. 4 illustrates a front view of the facial hair shaping tool and comb in its closed compact state and placed on top of a credit card, according to an embodiment.

FIG. 4 illustrates a front view of the facial hair shaping tool and comb 100 in its closed compact state and placed on top of a credit card 110, according to an embodiment. This comparison of size of the facial hair shaping tool and comb 100 in its closed compact state to the credit card 110 demonstrates a space-savings advantage where storage space may be limited. Dimensionally, the In sum, some advantages of the facial hair shaping tool and comb 100 in its closed compact state include 1) providing a compact size miniature comb that is smaller than a credit card and can fit inside pockets, small case, or wallet; and 2) providing a lightweight, durable, and rigid multi-purpose and convertible grooming tool for shaping and combing facial hair. Dimensionally, the miniature comb has a width (W2) of about 2¾ inches to 3 inches, and a length (L2) of about 1½ inches to 2 inches.

Figure 5A:
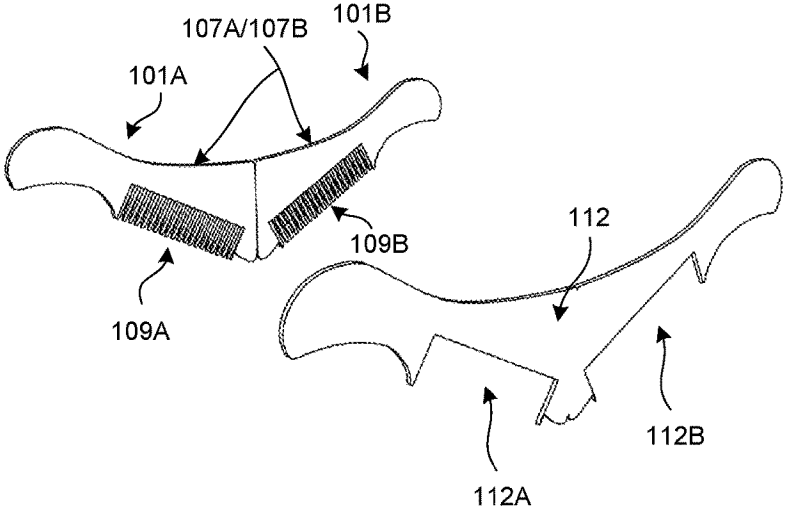
FIG. 5A-FIG. 5D illustrate various views of the facial hair shaping tool and comb having a shaped flexible adhesive fastener, according to an embodiment.
Figure 5B:
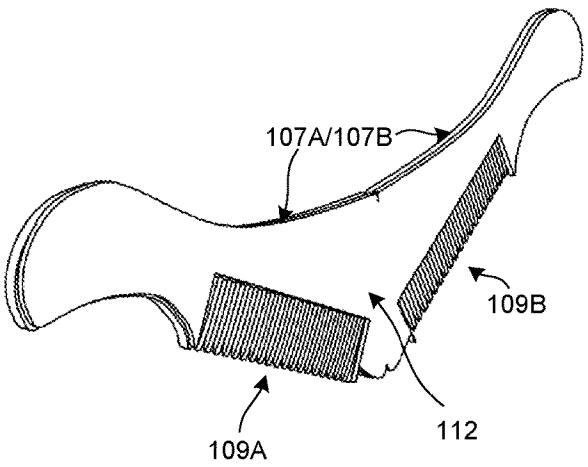
Figure 5C:
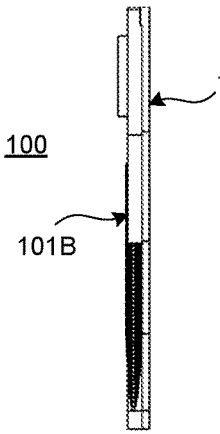
Figure 5D:
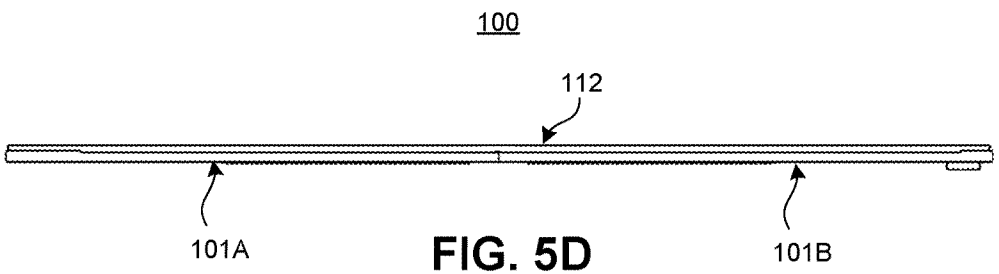

FIG. 5A-FIG. 5D illustrate various views of the facial hair shaping tool and comb 100 having a shaped flexible adhesive fastener 112, according to an embodiment. FIG. 5A illustrates an exploded view of the shaped flexible adhesive fastener 112 and the first guide member 101A and the second guide member 101B. In this embodiment, the shaped flexible adhesive fastener 112 may include a thin flexible adhesive material which is generally patterned to match the body of the first guide member 101A and the second guide member 101B. The shaped flexible adhesive fastener 114 may be applied to one side of the first guide member 101A and the second guide member 101B, coupling the guide members 101A/101B together to prevent separation, while still allowing the guide members 101A/101B to fold and unfold as discussed in the previous embodiment. Rectangular cutout sections, 112A and 112B are formed in the shaped flexible adhesive fastener 112, providing and opening for the first plurality of comb teeth 109A and the second plurality of comb teeth 109B. FIG. 5B-FIG. 5D illustrates a front perspective view, side view and top view of the shaped flexible adhesive fastener 112 applied to one side of first guide member 101A and the second guide member 101B. In practice, the shaped flexible adhesive fastener 112 may include vinyl wrap materials that provide a finished durable surface, offering a variety of colors and patterns.

Figure 6B:
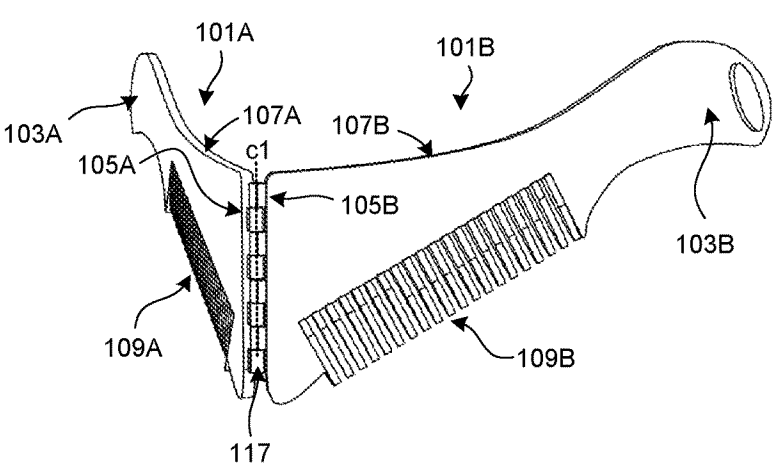
FIG. 6A-FIG. 6C illustrate various perspective views of the facial hair shaping tool and comb having a mechanical or magnetic type fastener, according to an embodiment.
Figure 6A:
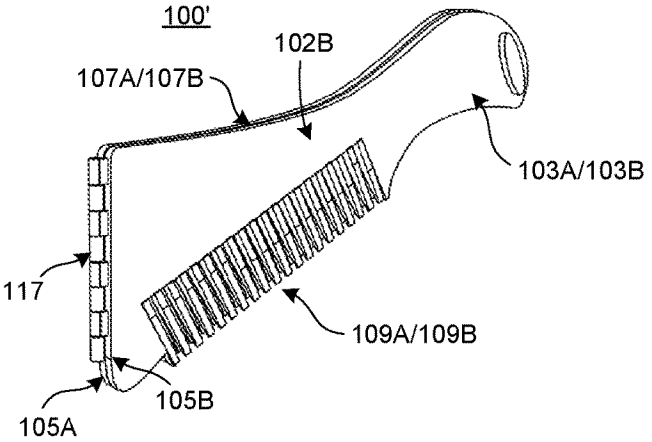
Figure 6C:
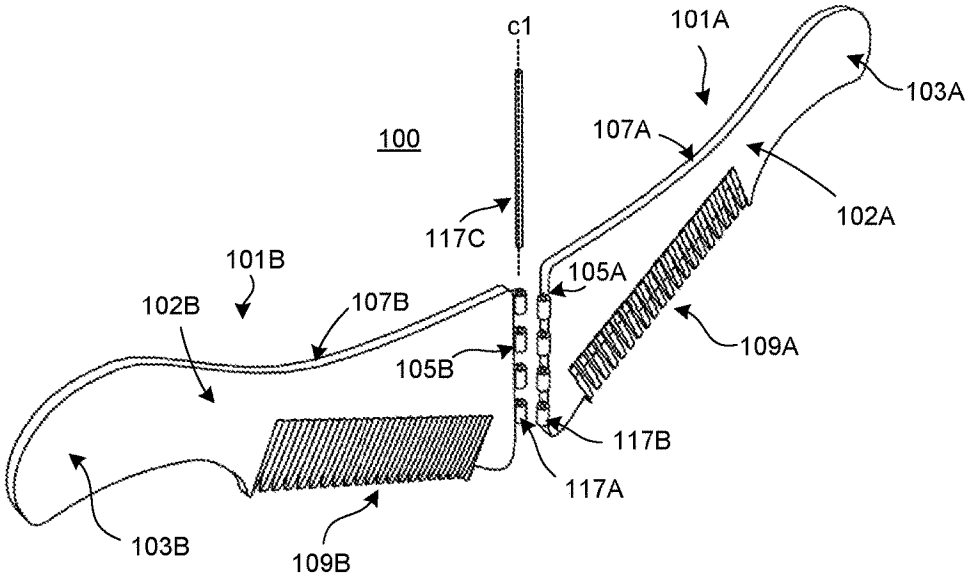

FIG. 6A-FIG. 6C illustrate various perspective views of the facial hair shaping tool and comb 100 having a mechanical or magnetic type fastener, according to an embodiment. Besides the flexible adhesive fastener 111, other types of fasteners may be used for connecting the first and second end portions, 105A and 105B. In one implementation, a barrel hinge 117 may include two or more cylinders, 117A and 117B, coupled by a hinge pin 117C. The two or more cylinders, 117A and 117B, are arranged in a single line, one on top of another, contacting each other lengthwise, and aligning the holes of each cylinder into which the hinge pin 117C may be inserted. A portion of the cylinder 117A may be attached to the first end portions 105A, while a portion the cylinder 117B is attached to the second end portions 105B, keeping the facial hair shaping tool and comb 100 connected while still allowing it to swivel about the hinge pin 117C at centerline c1. In another implementation, a magnetic hinge, having similar components to the barrel hinge fastener 117, excluding the hinge pin 117C, for magnetically connecting the first and second end portions, 105A and 105B, making it readily attachable and detachable. This magnetic hinge may include two or more magnetically attracting shafts (e.g., rollers, rods or cylinders) that are placed in parallel positions contacting each other lengthwise, at least one the magnetically attracting shaft is attached to the first end portions 105A, while the other one magnetically attracting shaft is attached to the second end portions 105B.

Figure 7A:
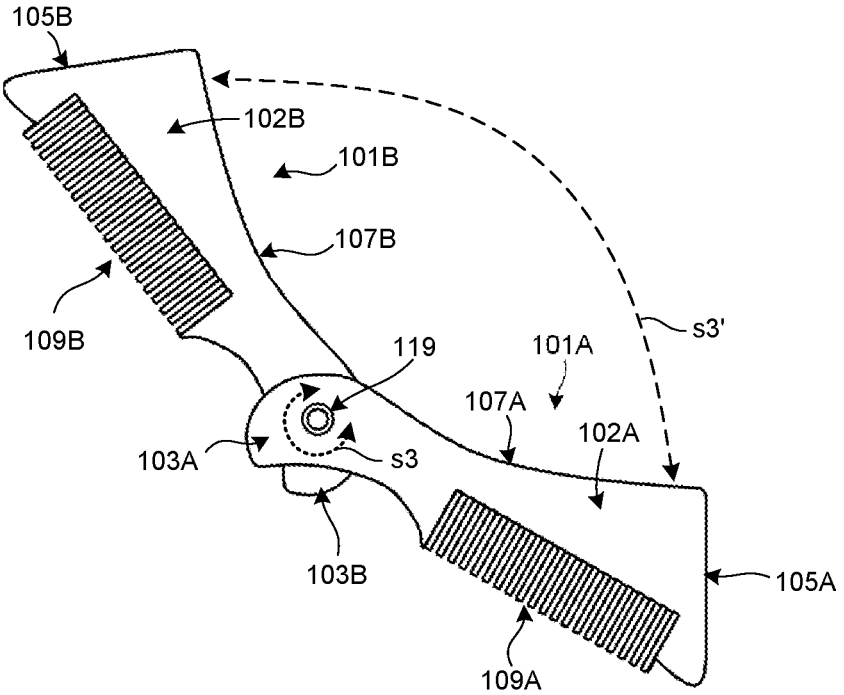
FIG. 7A-FIG. 7B illustrate a front view and a perspective view of the facial hair shaping tool and comb in the opened state with the first and second handles, coupled by a rod-type fastener, according to an embodiment.
Figure 7B:
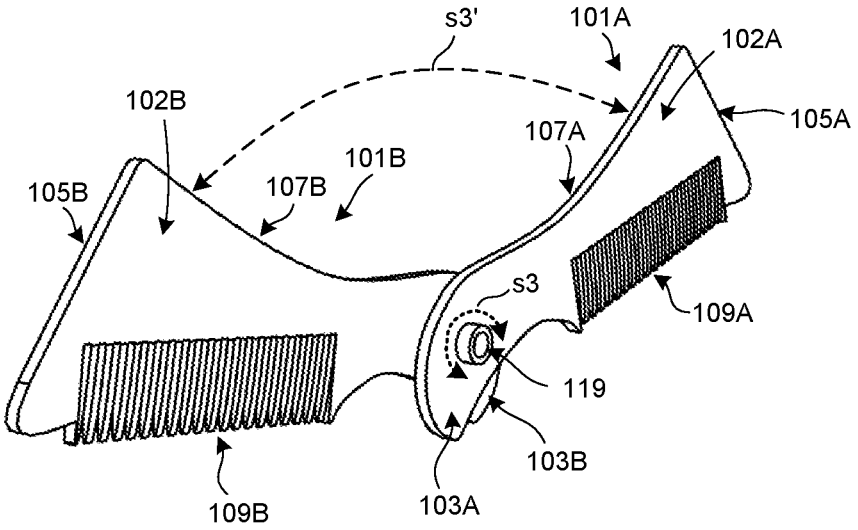

FIG. 7A-FIG. 7B illustrate a front view and a perspective view of the facial hair shaping tool and comb 100 in the opened state with the first and second handles, 103A and 103B, coupled by a rod-type fastener 119, according to an embodiment. The facial hair shaping tool and comb 100 as shown is in its opened state, and except for the different arrangement of the first guide member 101A and the second guide member 101B, the components in this embodiment are identical or similar to the previous embodiments described hereinabove. In the current arrangement, the rod-type fastener 119, is inserted into holes (not shown) situated near the center of the first and second handles, 103A and 103B, and configured to allow the first and second guide members, 101A and 101B to swivel and rotate s3 around the rod-type fastener 119, allowing the first and second end portions, 105A and 105B, to fold and unfold along a swivel path s3' for opening and closing the facial hair shaping tool and comb 100. Different types of rod-type fasteners 119 may be employed to couple the first and second handles, 103A and 103B, including but not limited to rollers, bolts, pins, rivets, cylinders, threaded or partially threaded screws, magnetic pins, magnetic pegs or magnetic discs.

Figure 8A:
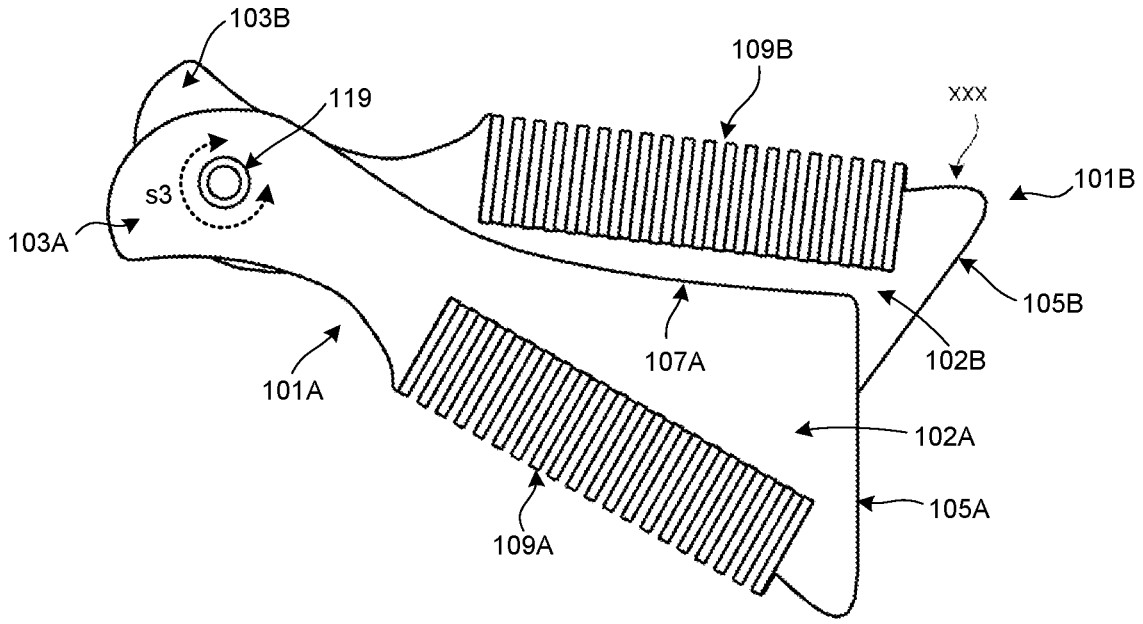
FIG. 8A-FIG. 8B illustrate a front view and a perspective view of the facial hair shaping tool and comb, in the closed state, with the first and second handles, coupled by the rod-type fastener, according to an embodiment.
Figure 8B:
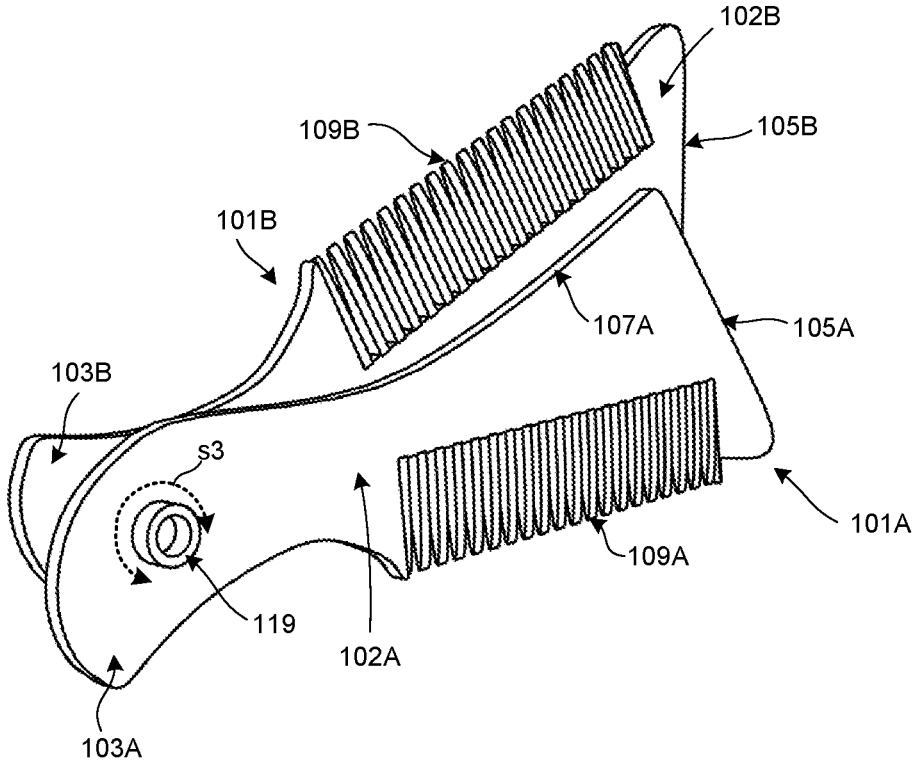
Figure 9A:
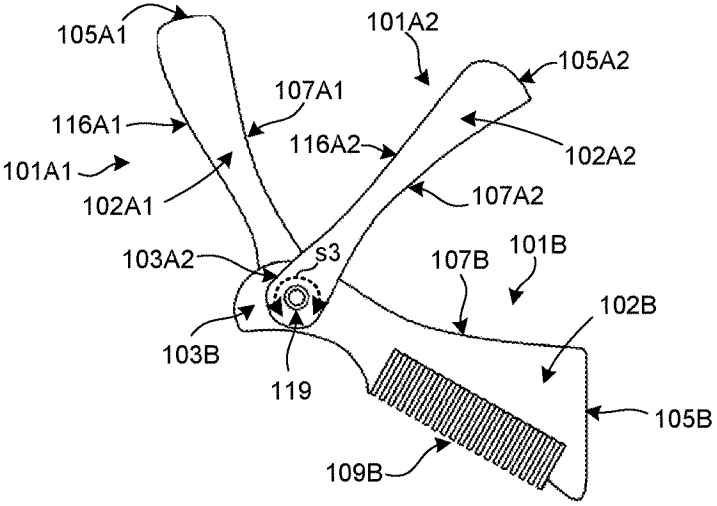
FIG. 9A-FIG. 9D illustrate various front views the facial hair shaping tool and comb, in the opened state, having multiple guide sub-members, according to an embodiment.
Figure 9B:
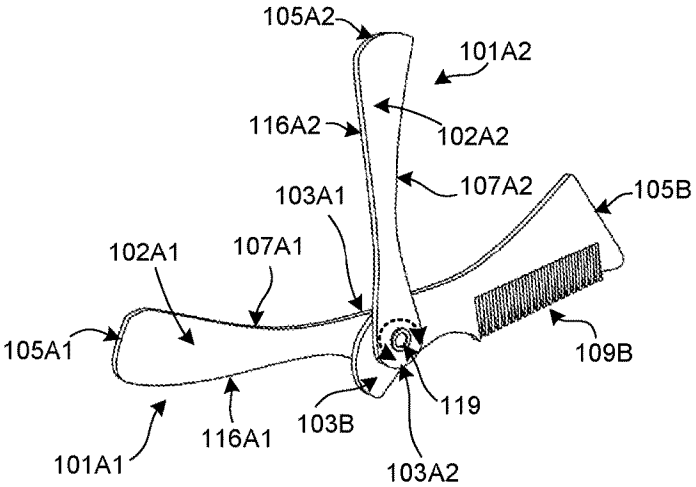
Figure 9C:
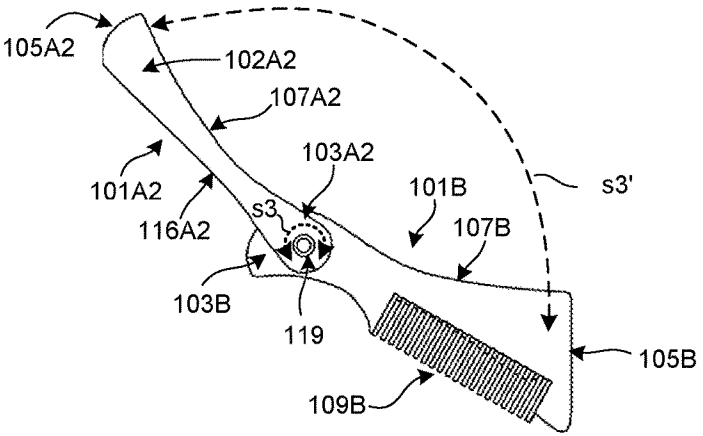
Figure 9D:
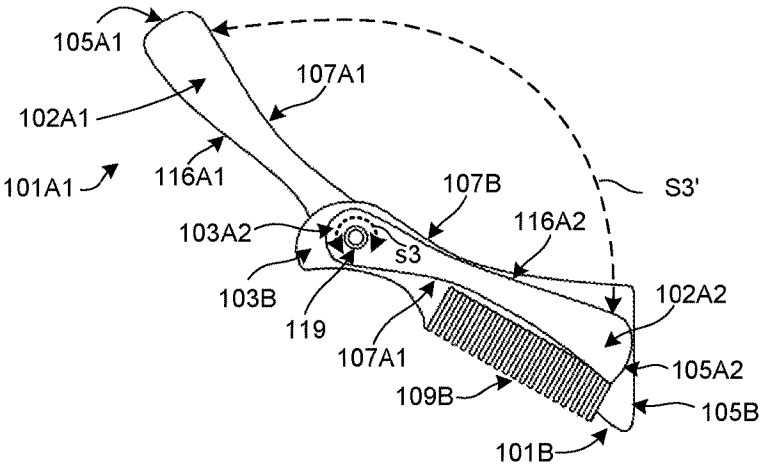

FIG. 8A-FIG. 8B illustrate a front view and a perspective view of the facial hair shaping tool and comb 100, in the closed state, with the first and second handles, 103A and 103B, coupled by the rod-type fastener 119, according to an embodiment. In this closed state, the facial hair shaping tool and comb 100 is converted into a miniature double sided comb. The quantity of teeth of the first comb 109A may be configured to be the same or different from the quantity of teeth of the second comb 109B. For example, the first and second set of teeth, 109A and 109B, may have several narrowly spaced teeth for use on fine hair or may have lesser quantity of wider spaced teeth for use on coarse hair. Alternatively, the first set of teeth 109A may have several narrowly spaced teeth for use on fine hair while the second set of teeth 109B may have lesser quantity of wider spaced teeth for use on coarse hair and vice versa.

FIG. 9A-FIG. 9D illustrate various front views the facial hair shaping tool and comb 100, in the opened state, having multiple guide sub-members, 101A1 and 101A2, according to an embodiment. Each guide sub-members, 101A1 and 101A2, may have elongated planar bodies with at least one curvilinear segment. The first guide sub-member 101A1 may include a first elongated planar sub-member 102A1, a first sub-member handle 103A1, a first sub-member end portion 105A1, and a first curvilinear sub-member segment 107A1 disposed on a first side of the first elongated planar sub-member 102A1 between the first sub-member handle 103A1 and the first sub-member end portion 105A1, while a second guide sub-member 101A2 may include a second elongated planar sub-member 102A2, a second sub-member handle 103A2, a second sub-member end portion 105A2, and a second curvilinear sub-member segment 107A2 disposed on a first side of the second elongated planar sub-member 102A2 between the second sub-member handle 103A2 and the second sub-member end portion 105A2. In the current arrangement, the rod-type fastener 119, may be inserted into holes (not shown) situated near the center of the first sub-member handle 103A1, the second sub-member handle 103A2, and the second handle 103B, and configured to allow the first and second guide sub-members, 101A1 and 101A2, and the second guide member 101B, to swivel and rotate s3 around the rod-type fastener 119. In practice, the first guide sub-member 101A1 and the second guide sub-member 101A2 may move independently from one another, allowing the first and second sub-member end portions, 105A1 and 105A2, to fold and unfold independently along the swivel path s3', and providing the user the ability to open and close the first guide sub-member 101A1 or to open and close the second guide sub-member 101A2 as needed. In addition, the first curvilinear sub-member segment 107A1 may be configured to have a different curved shape than the second curvilinear sub-member segment 107A1, providing multiple facial hair shaping tools to the user. In yet another implementation, one of the sub-members or both sub-members, 101A1 and 101A2, may have a razor edge disposed along a lengthwise longitudinal edge portion, 116A1 and/or 116A2, and disposed on along an edge of the first or second elongated planar sub-members, 102A1 or 102A2, for shaving the facial hair of the user.

Figure 10A:
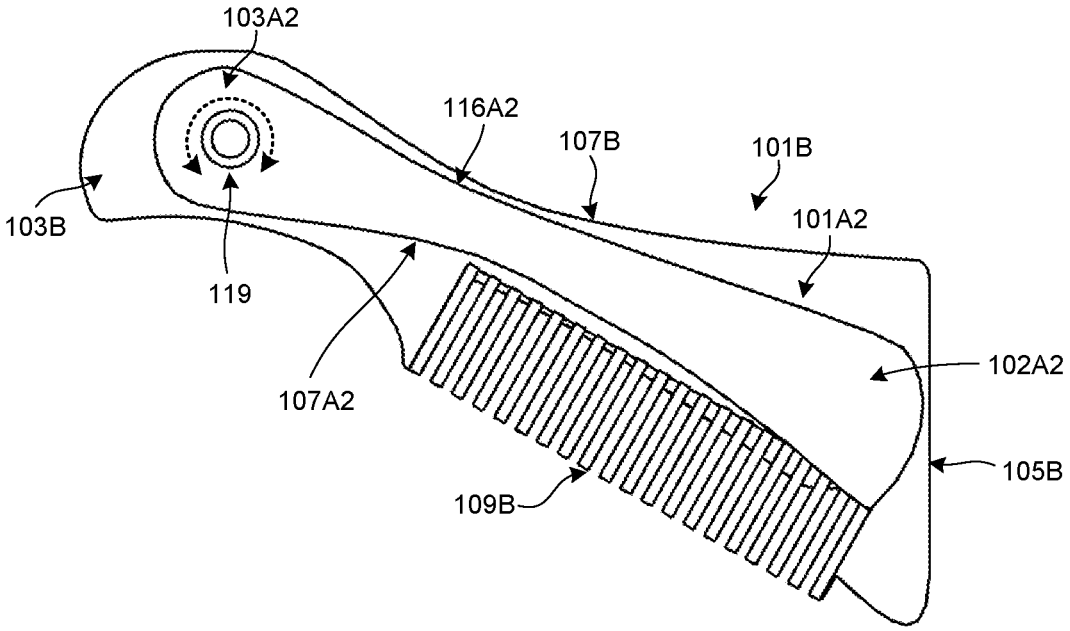
FIG. 10A-FIG. 10B illustrate a front view and a perspective view of the facial hair shaping tool and comb having multiple guide sub-members in the closed state, according to an embodiment.
Figure 10B:
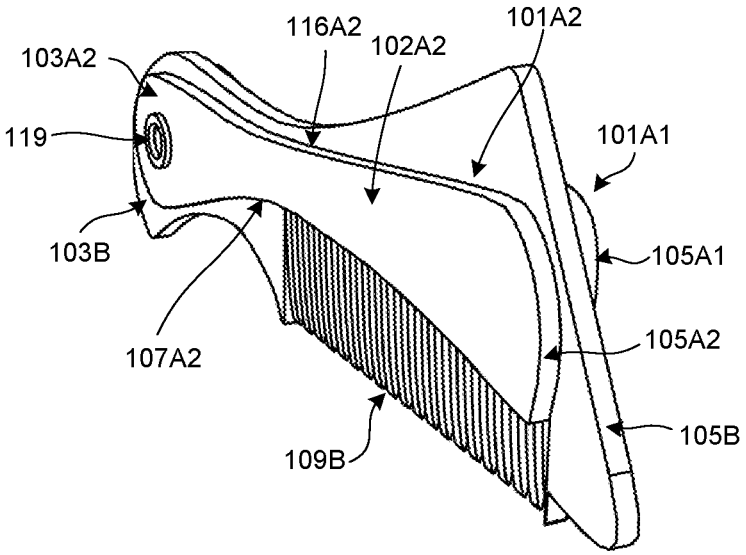
Figure 11A:
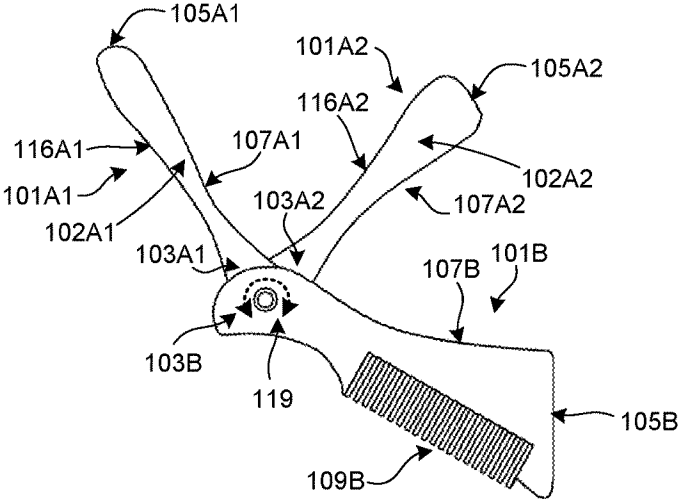
FIG. 11A-FIG. 11D illustrate various front views the facial hair shaping tool and comb in the opened state, having multiple guide slotted sub-members, according to an embodiment.
Figure 11B:
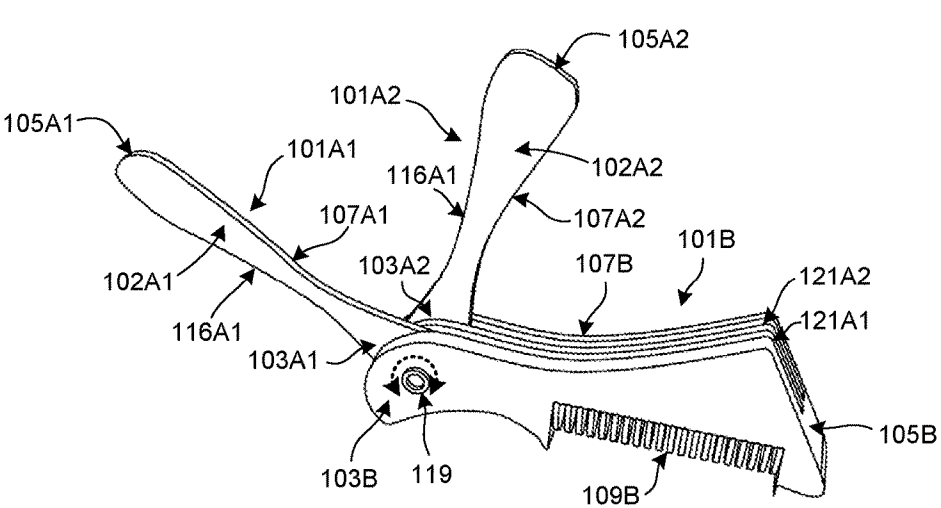
Figure 11C:
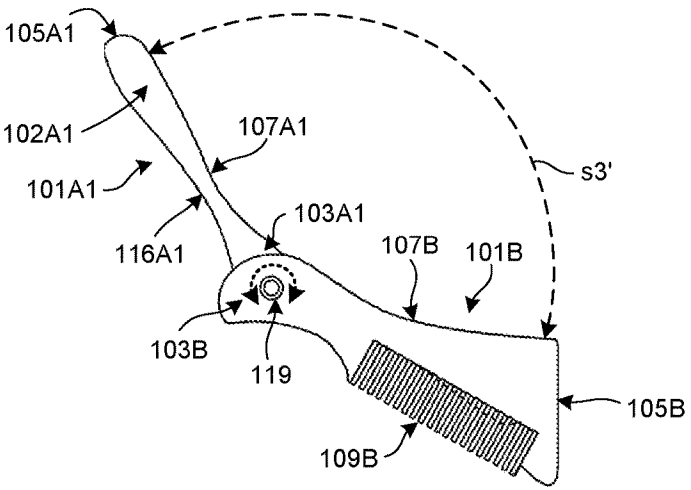
Figure 11D:
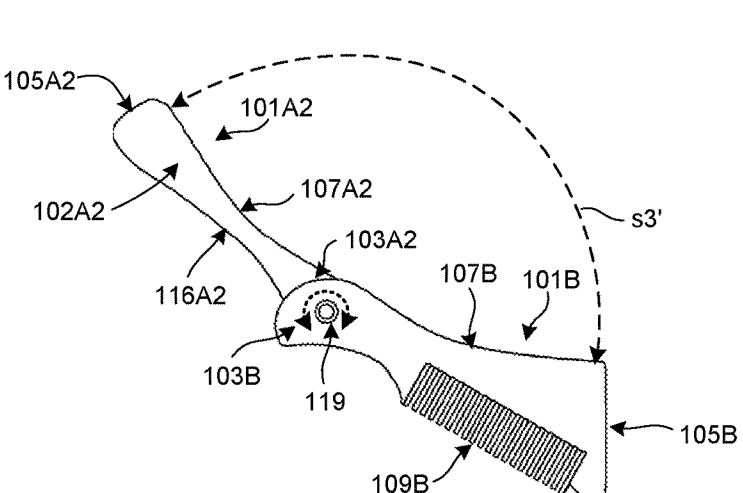

FIG. 10A-FIG. 10B illustrate a front view and a perspective view of the facial hair shaping tool and comb 100 having multiple guide sub-members, 101A1 and 101A2, in the closed state, according to an embodiment. In this closed state, the facial hair shaping tool and comb 100 may be converted into a miniature single comb, having the first and second guide sub-members, 101A1 and 101A2, disposed slightly above the comb teeth 109B, not obstructing the comb teeth 109B. In another embodiment, the guide sub-members may be supported by a dynamic fastener having a two-piece releasable interlock, magnetic couplers, or quick-release locking mechanism, making the guide sub-members, 101A1 and 101A2, detachable and/or replaceable components, and allowing the user the ability to replace broken parts or upgrade parts to sub-members that are designed with customized curvilinear sub-member segments, 107A1 or 107A2, providing the user other types of custom beard shaping styles.

FIG. 11A-FIG. 11D illustrate various front views the facial hair shaping tool and comb 100, in the opened state, having multiple guide slotted sub-members, 101A1 and 101A2, according to an embodiment. Each guide sub-members, 101A1 and 101A2, may have elongated planar bodies with at least one curvilinear segment. The first guide sub-member 101A1 may include a first elongated planar sub-member 102A1, a first sub-member handle 103A1, a first sub-member end portion 105A1, and a first curvilinear sub-member segment 107A1 disposed on a first side of the first elongated planar sub-member 102A1 between the first sub-member handle 103A1 and the first sub-member end portion 105A1, while a second guide sub-member 101A2 may include a second elongated planar sub-member 102A2, a second sub-member handle 103A2, a second sub-member end portion 105A2, and a second curvilinear sub-member segment 107A2 disposed on a first side of the second elongated planar sub-member 102A2 between the second sub-member handle 103A2 and the second sub-member end portion 105A2. In the current arrangement, the rod-type fastener 119, may be inserted into holes (not shown) situated near the center of the first sub-member handle 103A1, the second sub-member handle 103A2, and the second handle 103B, and configured to allow the first and second guide sub-members, 101A1 and 101A2, and the second guide member 101B, to swivel and rotate s3 around the rod-type fastener 119. Furthermore, in this embodiment, the second guide member 101B may also include multiple guide slots, 121A1 and 121A2, disposed between the second handle 103B and second end portion 105B for receiving and housing the first and second guide sub-members, 101A1 and 101A2, when the facial hair shaping tool and comb 100 is in the closed state. In practice, the first guide sub-member 101A1 and the second guide sub-member 101A2 may move independently from one another, allowing the first and second sub-member end portions, 105A1 and 105A2, to fold and unfold independently along the swivel path s3', and providing the user the ability to open and close the first guide sub-member 101A1 or to open and close the second guide sub-member 101A2 as desired. In addition, the first curvilinear sub-member segment 107A1 may be configured to have a different curved pattern than the second curvilinear sub-member segment 107A1, providing multiple facial hair shaping tools to the user. In yet another embodiment, one of the sub-members or both sub-members, 101A1 and 101A2, may have a razor edge disposed along a lengthwise longitudinal edge portion, 116A1 and/or 116A2, and disposed on an opposite side of the curvilinear sub-member segment, 107A1 or 107A2, for shaving the facial hair of the user.

Figure 12A:
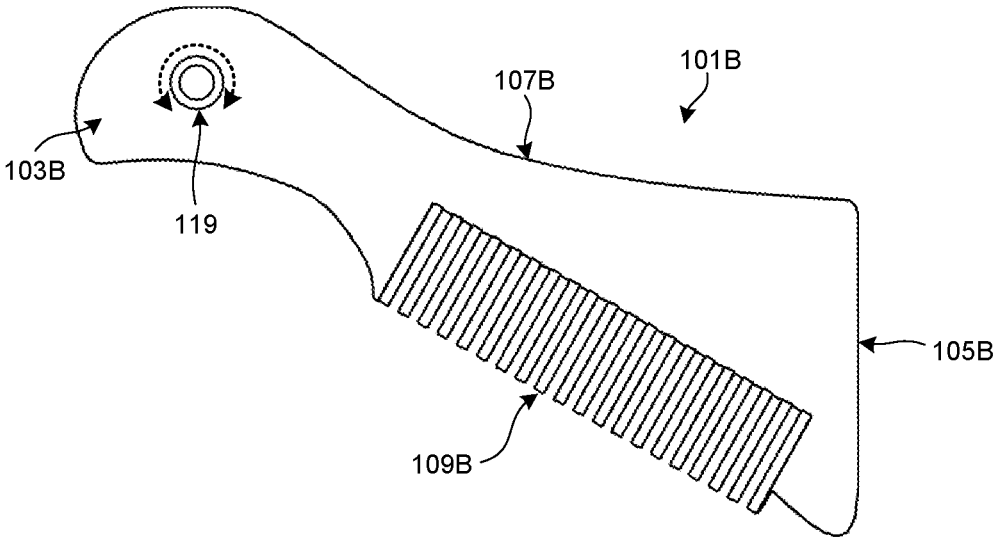
FIG. 12A-FIG. 12B illustrate a front view and a perspective view of the facial hair shaping tool and comb having multiple slotted guide sub-members in the closed state, according to an embodiment.
Figure 12B:
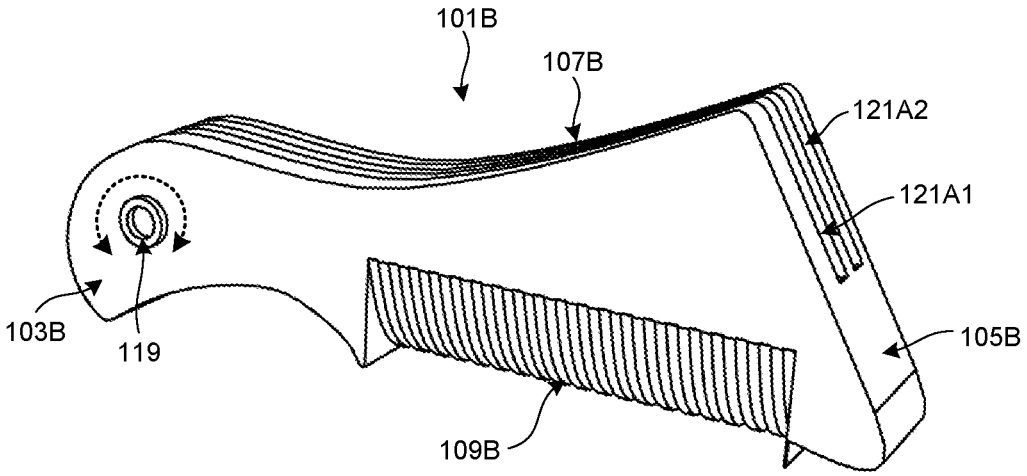

FIG. 12A-FIG. 12B illustrate a front view and a perspective view of the facial hair shaping tool and comb 100 having multiple slotted guide sub-members, 101A1 and 101A2 in the closed state, according to an embodiment. In this closed state, the first guide sub-member 101A1 and the second guide sub-member 101A2 are inserted and fully housed into the multiple guide slots, 121A1 and 121A2, allowing the facial hair shaping tool and comb 100 to be converted into a miniature comb. In another embodiment, the guide sub-members may be supported by a dynamic fastener having a two-piece releasable interlock, magnetic couplers, or quick-release locking mechanism, making the guide sub-members, 101A1 and 101A2, detachable and/or replaceable components, and allowing the user the ability to replace broken parts or upgrade parts to sub-members that are designed with customized curvilinear sub-member segments, 107A1 or 107A2, providing the user other types of custom beard shaping styles.

Figure 13:
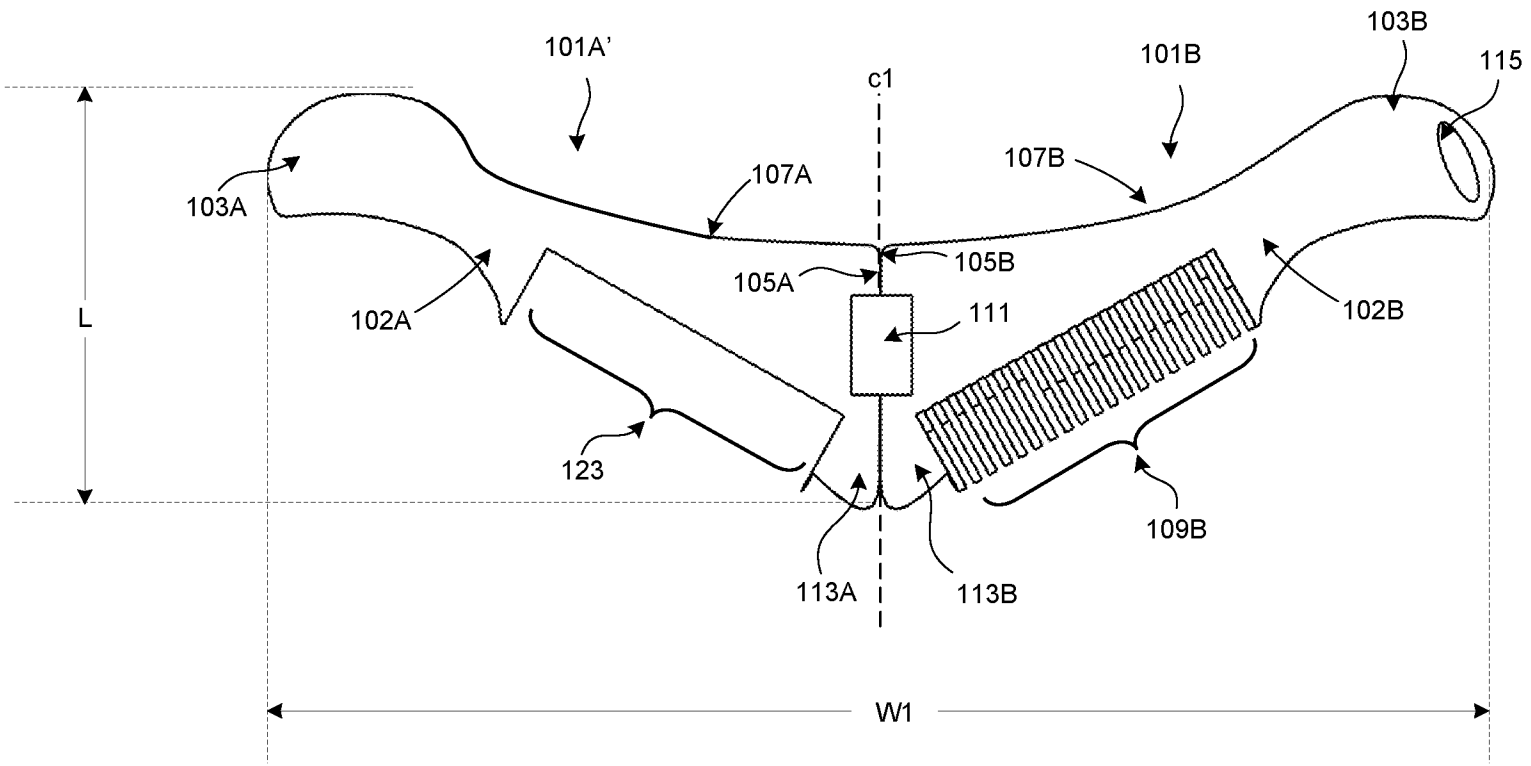
FIG. 13 illustrates a front view of the facial hair shaping tool and comb in the opened state, having different types of guide members attached via the flexible adhesive fastener, according to an embodiment.

FIG. 13 illustrates a front view of the facial hair shaping tool and comb 100, in the opened state, having different types of guide members attached via the flexible adhesive fastener, according to an embodiment. As depicted in this embodiment, the facial hair shaping tool and comb 100 may include a first guide member 101A' and a second guide member 101B having different shapes and arranged along a centerline c1 disposed between the first guide member 101A' and the second guide member 101B at two end portions 105A, 105B. Each guide member, 101A' and 101B, is relatively thin compared to its overall size, having an elongated planar body with at least one curvilinear segment, and includes additional members that allows the facial hair shaping tool and comb 100 to convert between an opened state, full-length facial hair shaping tool, to a closed compact state, miniature comb, and vice versa. In this embodiment, first guide member 101A' may include a first elongated planar body 102A, a first handle 103A, a first end portion 105A, a first curvilinear segment 107A disposed on a first side of the first elongated planar body 102A between the first handle 103A and the first end portion 105A, and comb slot 123 disposed on a second side of the first elongated planar body 102A between the first handle 103A and the first end portion 105A. The second guide member 101B may include a second elongated planar body 102B, a second handle 103B, a second end portion 105B, a second curvilinear segment 107B disposed on a first side of the second elongated planar body 102B between the second handle 103B and the second end portion 105B, and a second plurality of comb teeth 109B disposed on a second side of the second elongated planar body 102B and between the second handle 103B and the second end portion 105B. A flexible adhesive fastener 111 may be applied to the front and/or back side face of the facial hair shaping tool and comb 100 at the first and second end portions, 105A and 105B, coupling and joining the first guide member 101A to the second guide member 101B, allowing it to fold and unfold along the centerline c1. The first curvilinear segment 107A of the first guide member 101A' has a curve shape that is different from the second curvilinear segment 107A of the second guide member 101B, providing the user another style for shaping facial hair.

Figure 14B:
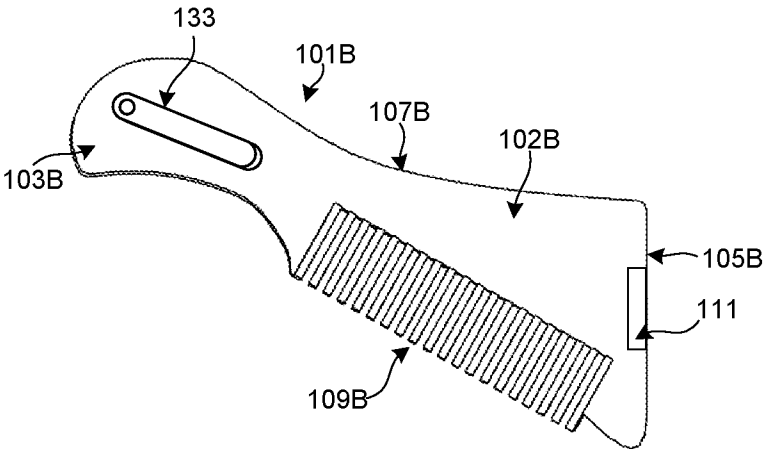
FIG. 14A-FIG. 14B illustrate front views of the facial hair shaping tool and comb in the closed state, having retainer components, according to an embodiment.
Figure 14A:
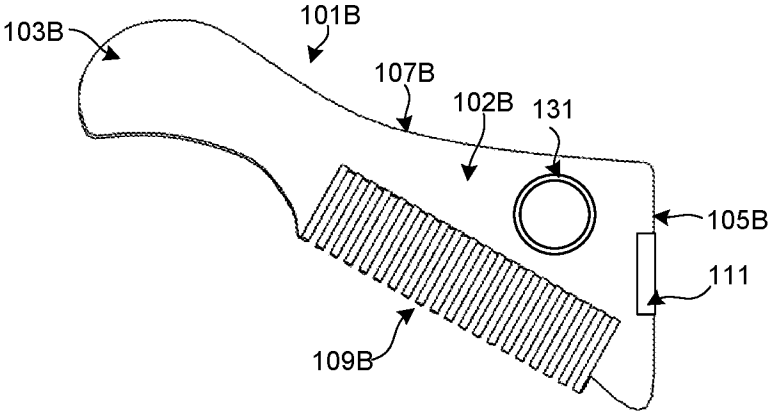

FIG. 14A-FIG. 14B illustrate front views of the facial hair shaping tool and comb 100, in the closed state, having retainer components, according to an embodiment. These retaining components may include a magnet 131 coupled to the first or second elongated planar body, 102A or 102B, near the first or second end portion, 105A or 105B, and clip 133 coupled on the first or second handle, 103A or 103B, allowing the user to secure the facial hair shaping tool and comb 100 on their clothing or medicine cabinet.

Figures 15A, 15B:
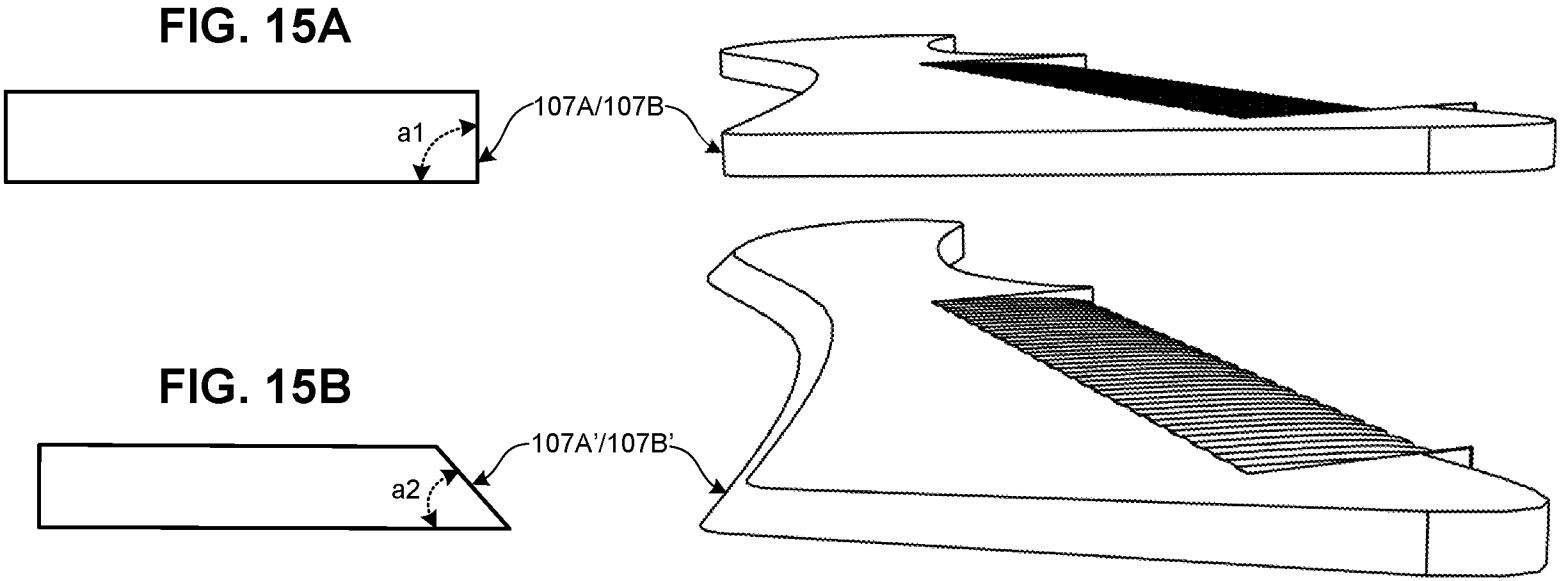
FIG. 15A-FIG. 15B illustrate side profile views of the first or second curvilinear segment, according to an embodiment.

FIG. 15A-FIG. 15B illustrate side profile views of the first or second curvilinear segment, 107A or 107B, according to an embodiment. In FIG. 15A, the first or second curvilinear segment, 107A or 107B, may include a sloped edge that is approximately perpendicular or 90 degrees (a1). In FIG. 15B, the sloped edge of the first or second curvilinear segment, 107A or 107B, may have an acute angle (a2) (i.e., less than 90 degrees). In practice, the sloped edge with acute angle (a2) provides a smooth transition between the surface of the user's skin and an edge of the first and second curvilinear segments, 107A and 107B, allowing the razor blade to rise above sloped edge of the first or second curvilinear segment, 107A or 107B for a clean shave.

Figure 16:
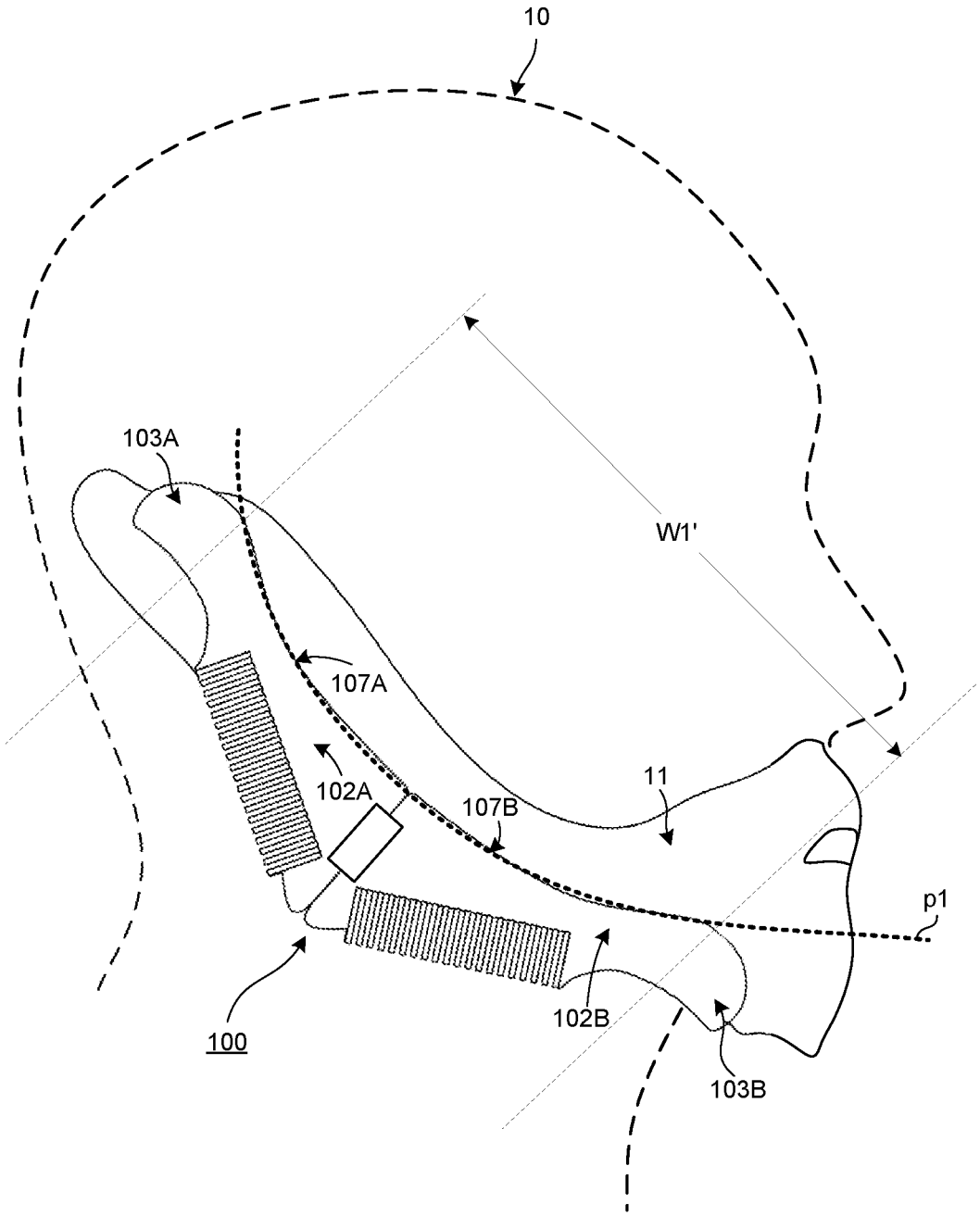
FIG. 16 illustrates a side view of the full-length facial hair shaping tool applied against a part a beard of a user when the facial hair shaping tool and comb is in the opened state, according to an embodiment.

FIG. 16 illustrates a side view of the full-length facial hair shaping tool applied against a part a beard 11 of a user 10 when the facial hair shaping tool and comb 100 is in the opened state, according to an embodiment. The user 10 may employ the facial hair shaping tool and comb 100 to shape the beard 11 by lining up the first and second curvilinear segments, 107A and 107B, forming a single curved shaping path (p1), against the beard in accordance with the shape of curve style desired by the user 10. For example, by grasping a portion of the facial hair shaping tool and comb 100, the user 10 may align the tool 100 at the desired position and path (p1) along a side portion of the user's face and simultaneously press and hold the facial hair shaping tool and comb 100 against the user's beard 11 at an angle, forming a sloped barrier. Next, with a razor's sharp edge, the user 10 may shave and remove the exposed facial hair along the first and second curvilinear segments, 107A and 107B, in order to achieve the desired beard shape. In practice, the facial hair shaping tool and comb 100 is held at an angle of approximately 45 degrees against the face of the user 10 to achieve the appropriate sloped barrier on which a razor's sharp edge rests against after shaving. In combination, the first and second elongated planar bodies, 102A and 102B, act as a barrier, masking and covering protected facial hair from being removed by the razor's sharp edge. In addition to being an ideal tool for shaping the user's beard 11, the facial hair shaping tool and comb 100 can also be easily applied to shape other facial hair, including sideburns, mustaches, chin-beards, and eyebrows as described hereinabove. In the opened state, the facial hair shaping tool and comb 100 has a usable shaping width (W1') of approximately 5 inches to 5 inches.

Figure 17:
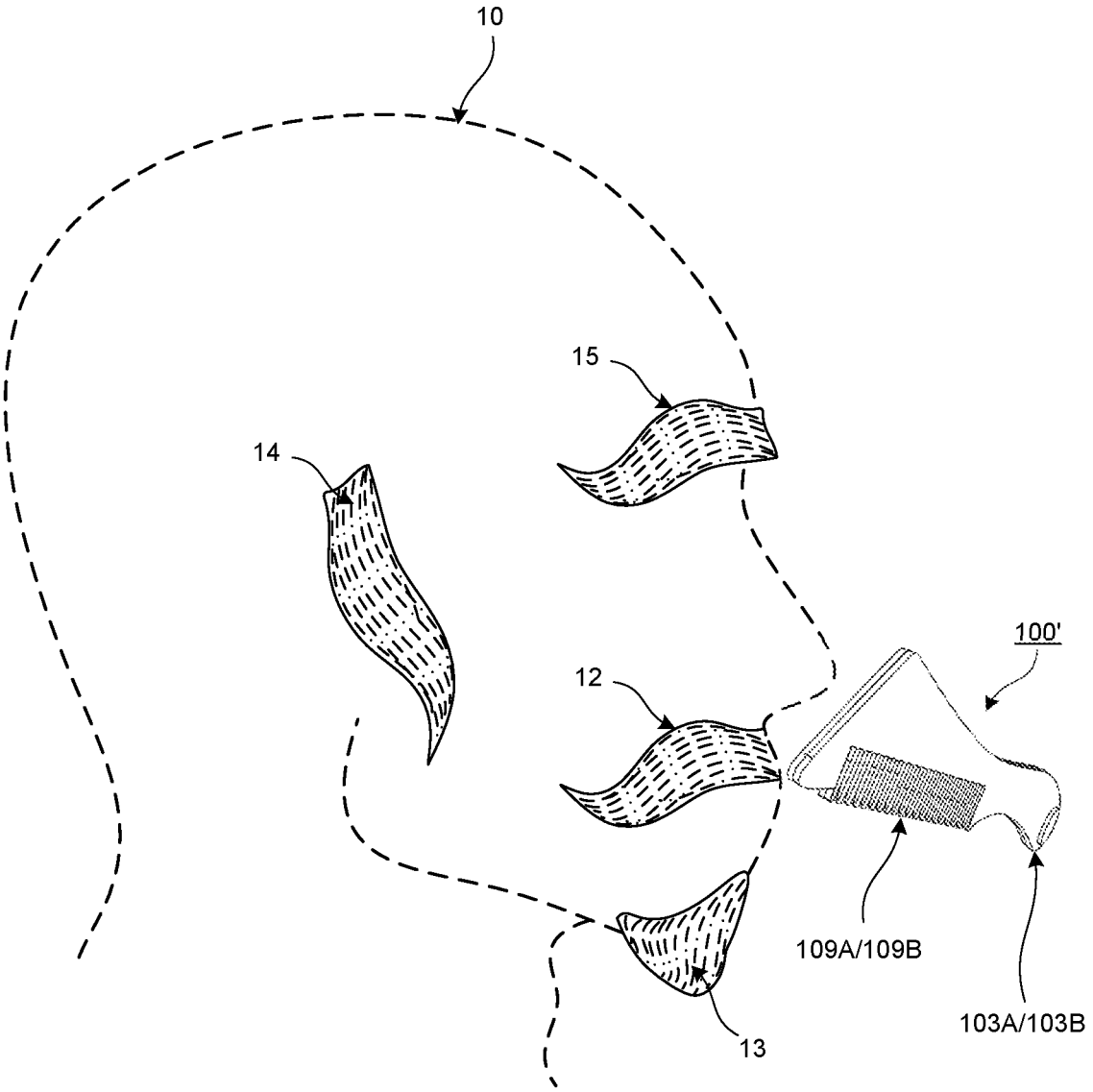
FIG. 17 illustrates a side view of the miniature comb for grooming small areas of facial hair on the user, when the facial hair shaping tool and comb is in the closed state, according to an embodiment.

FIG. 17 illustrates a side view of the miniature comb for grooming small areas of facial hair on the user 10, when the facial hair shaping tool and comb 100 is in the closed state, according to an embodiment. Because the plurality of teeth assembly 109A/109B of the miniature comb is limited and reduced in size, it is practical and ideal for combing small patches or areas of facial hair such as mustaches 12, chinbeards 13, sideburns 14, and eyebrows 15. However, because of its reduced size, it is ideal for storing it in small pockets, wallets, or utility cases as an everyday carry item, providing the user the convenience of having a compact and convertible grooming tool on hand anytime and anywhere.

Figure 18B:
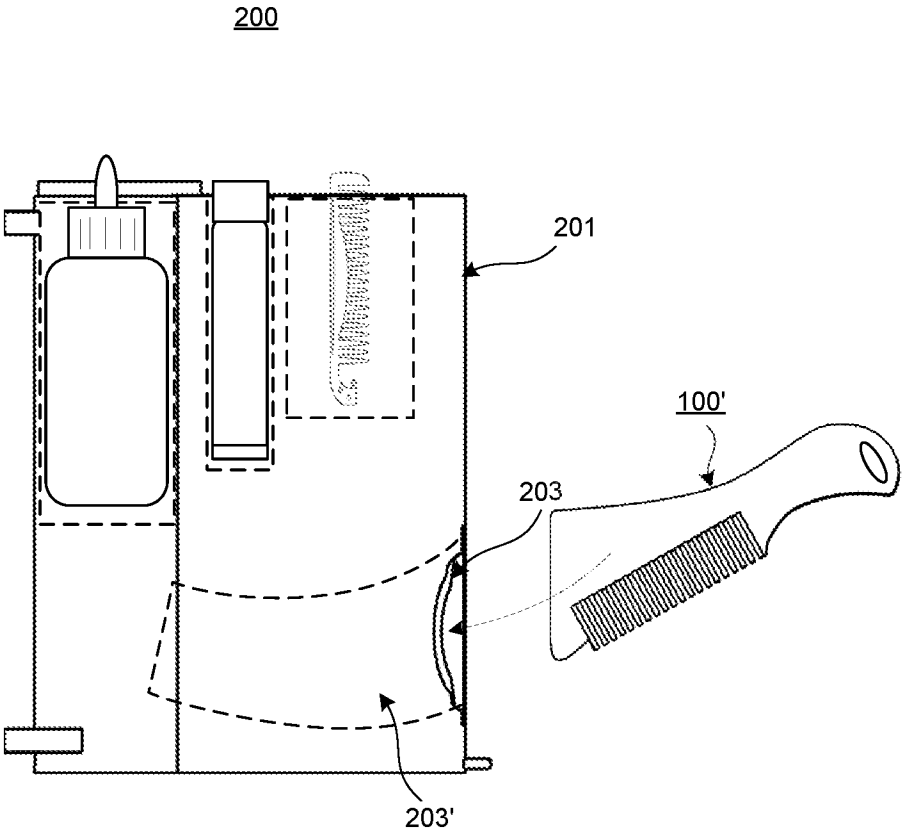
FIG. 18A-FIG. 18B illustrate side views of the facial hair shaping tool and comb used in combination with the pocket utility case and travel tool, according to an embodiment.
Figure 18A:
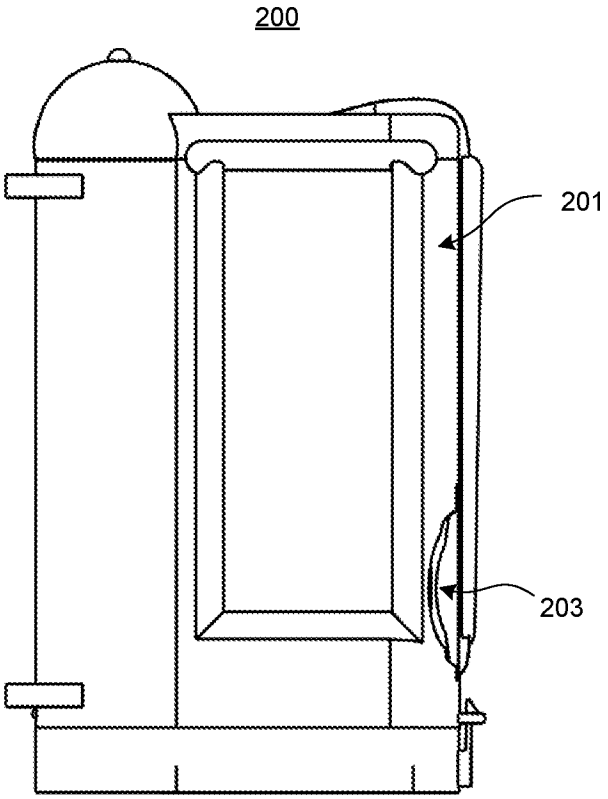

FIG. 18A-FIG. 18B illustrate side views of the facial hair shaping tool and comb 100 used in combination with the pocket utility case and travel tool 200 as described in U.S. application Ser. No. 16/278,715, which is incorporated by reference to the present application. As discussed in the previous application, the pocket utility case and travel tool 200 may store various items grooming tools. For example, the pocket utility case and travel tool 100 may include a housing 20' that has a compartment slot opening 203 that is configured to receive and store the facial hair shaping tool and comb 100 in a compartment slot insert 203' disposed within the housing 200.

Figure 19:
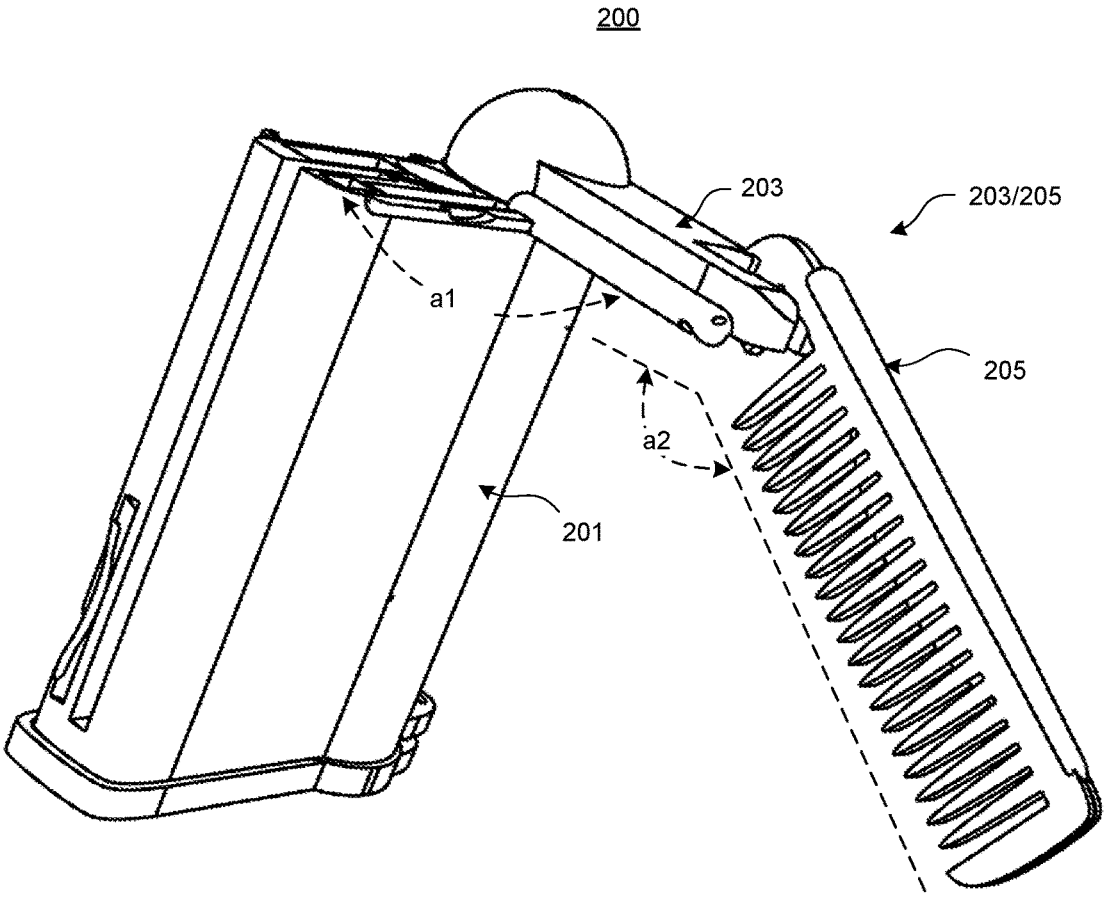
FIG. 19 illustrates a side view of the pocket utility case and travel tool with a stand assembly, according to an embodiment.

FIG. 19 illustrates a side view of the pocket utility case and travel tool 100 with a stand assembly, according to an embodiment. The detachable lid 203 and the pivoting comb 205 of the pocket utility case and travel tool 100 may be configured as a stand assembly 203/205 to tilt the housing 201 at an angle. In practice, the stand assembly 203/205 is configured by 1) rotating the a detachable lid 203 at a first angle (a1) relative to the housing 201; and then 2) rotating the pivoting comb 205 at a second angle (a2) relative to the detachable lid 203. The first angle (a1) having a rotation range of approximately 0 to 90 degrees, while the second angle (a2) having a rotation range of approximately 25 to 90 degrees. The user may prop up the stand assembly 203/205 to view the mirror (not shown) disposed on the opposite side of the stand assembly 203/205 at an appropriate viewing tilt while shaving or grooming.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is:

1. A facial hair shaping tool and comb for shaping and grooming facial hair of a user, comprising:

a first guide member having a first elongated planar body, a first handle, a first end portion, a first curvilinear segment disposed on a first side of the first elongated planar body between the first handle and the first end portion, and a first plurality of comb teeth disposed on a second side of the first elongated planar body between the first handle and the first end portion; and a second guide member having a second elongated planar body, a second handle, a second end portion, and a second curvilinear segment disposed on a first side of the second elongated planar body between the second handle and the second end portion, and a second plurality of comb teeth disposed on a second side of the second elongated planar body between the second handle and the second end portion, wherein the first guide member is coupled to the second guide member by a fastener, allowing the first guide member or the second guide member to move and enabling the facial hair shaping tool and comb to be in an opened state or a closed state, wherein the first guide member and the second guide member are symmetrically arranged to one another relative to a centerline disposed between the first guide member and the second guide member, wherein the first guide member and the second guide member are converted into a conjoined facial hair shaping tool when the facial hair shaping tool and comb is in the opened state, wherein the first elongated planar body and the second elongated planar body act as a barrier for masking the facial hair of the user from being removed by a razor when shaving, wherein the first guide member and the second guide member are converted into a miniature comb when the facial hair shaping tool and comb is in the closed state, wherein the first end portion is coupled to the second end portion by the fastener, and wherein the fastener comprises a flexible adhesive fastener applied to at least one side of the facial hair shaping tool and comb, wherein the first guide member is coupled to the second guide member via the flexible adhesive fastener, allowing the facial hair shaping tool and comb to fold and unfold along the centerline.

2. The facial hair shaping tool and comb of claim 1, wherein the first curvilinear segment and the second curvilinear segment are conjoined forming a single curvilinear segment.

3. The facial hair shaping tool and comb of claim 1, wherein the first handle lies horizontally flat and against the second handle, forming a single handle assembly in the closed state.

4. The facial hair shaping tool and comb of claim 1, wherein the first elongated body and the second elongated body act as a barrier, masking and covering a protected portion of the facial hair.

5. The facial hair shaping tool and comb of claim 1, wherein the facial hair shaping tool and comb in the opened state has a width of about 5½ inches to 6 inches and a length of about 1¾ inches to 2¼ inches.

6. The facial hair shaping tool and comb of claim 1, wherein the facial hair shaping tool and comb in the opened state has a thickness of about 1.5 mm to 3 mm.

7. The facial hair shaping tool and comb of claim 1, wherein a retainer clip or a magnet is coupled to the miniature comb.

8. The facial hair shaping tool and comb of claim 1, wherein the flexible adhesive fastener comprises a shaped flexible adhesive fastener, having a thin flexible adhesive material which is patterned to match a shape of the first guide member and the second guide member.

9. The facial hair shaping tool and comb of claim 1, wherein the fastener includes a mechanical or a magnetic fastener connected to the first end portion and the second end portion, wherein the first guide member is coupled to the second guide member via the mechanical or the magnetic fastener, allowing the facial hair shaping tool and comb to fold and unfold along the centerline.

10. The facial hair shaping tool and comb of claim 1, wherein the first plurality of comb teeth are structurally aligned and in contact with the second plurality of comb teeth, forming a single comb assembly in the closed state.

11. The facial hair shaping tool and comb of claim 10, wherein the single comb assembly is approximately 35 mm 45 mm in width and approximately 8 mm 12 mm in length, having finely spaced or coarsely spaced teeth.

12. The facial hair shaping tool and comb of claim 1, wherein the first curvilinear segment or the second curvilinear segment includes a sloped edge.

13. The facial hair shaping tool and comb of claim 12, wherein the sloped edge has an acute angle.

14. The facial hair shaping tool and comb of claim 1, wherein the first handle is coupled to the second handle by the fastener.

15. The compact and convertible facial hair shaping tool and comb of claim 14, wherein the fastener comprises a rod-type fastener inserted into a plurality of holes disposed near a center portion of the first handle and the second handle, allowing the first guide member and second guide member to rotate around the rod-type fastener.

16. The compact and convertible facial hair shaping tool and comb of claim 14, wherein the fastener comprises rollers, bolts, pins, rivets, cylinders, threaded or partially threaded screws, magnetic pins, magnetic pegs or magnetic discs.

17. A facial hair shaping tool and comb for shaping and grooming facial hair of a user, comprising:

a first guide member having a first elongated planar body, a first handle, a first end portion, a first curvilinear segment disposed on a first side of the first elongated planar body between the first handle and the first end portion, and a first plurality of comb teeth disposed on a second side of the first elongated planar body between the first handle and the first end portion; and a second guide member having a second elongated planar body, a second handle, a second end portion, and a second curvilinear segment disposed on a first side of the second elongated planar body between the second handle and the second end portion, and a second plurality of comb teeth disposed on a second side of the second elongated planar body between the second handle and the second end portion, wherein the first guide member is coupled to the second guide member by a fastener, allowing the first guide member or the second guide member to move and enabling the facial hair shaping tool and comb to be in an opened state or a closed state, wherein the first guide member and the second guide member are symmetrically arranged to one another relative to a centerline disposed between the first guide member and the second guide member, wherein the first guide member and the second guide member are converted into a conjoined facial hair shaping tool when the facial hair shaping tool and comb is in the opened state, wherein the fastener comprises a flexible adhesive fastener applied to at least one side of the facial hair shaping tool and comb, wherein the first guide member is coupled to the second guide member via the flexible adhesive fastener, allowing the facial hair shaping tool and comb to fold and unfold along the centerline, and wherein the first guide member and the second guide member are converted into a miniature comb when the facial hair shaping tool and comb is in the closed state.

18. The facial hair shaping tool and comb of claim 17, wherein the flexible adhesive fastener comprises a shaped flexible adhesive fastener, having a thin flexible adhesive material which is patterned to match a shape of the first guide member and the second guide member.

* * * * *